US007803025B2

(12) United States Patent
Denis et al.

(10) Patent No.: US 7,803,025 B2
(45) Date of Patent: Sep. 28, 2010

(54) SYSTEM FOR MOUNTING A MARINE JET PROPULSION SYSTEM

(75) Inventors: Andre Denis, Sherbrooke (CA); Michel Bourret, Drummonville (CA); Marc Schuler, Sherbrooke (CA)

(73) Assignee: Bombardier Recreational Products Inc., Valcourt (CA)

( * ) Notice: Subject to any disclaimer, the term of this patent is extended or adjusted under 35 U.S.C. 154(b) by 219 days.

(21) Appl. No.: 12/046,702

(22) Filed: Mar. 12, 2008

(65) Prior Publication Data

US 2009/0233499 A1 Sep. 17, 2009

(51) Int. Cl.
*B63H 11/00* (2006.01)

(52) U.S. Cl. ..... 440/38

(58) Field of Classification Search ..... 440/38
See application file for complete search history.

(56) References Cited

U.S. PATENT DOCUMENTS 5,460,553 A 10/1995 Craig et al.
6,101,965 A * 8/2000 Koyanagi ..... 114/288
7,179,142 B2 2/2007 Fuse

* cited by examiner

*Primary Examiner*—Stephen Avila
(74) *Attorney, Agent, or Firm*—Osler, Hoskin & Harcourt LLP

(57) ABSTRACT

A watercraft has a hull and a deck disposed above the hull. A ride plate is mounted below a rear portion of the hull. A jet pump assembly includes a jet pump disposed at least in part between the ride plate and the hull. A front wall is formed at least in part by the hull and disposed forwardly of the jet pump. The jet pump assembly is mounted on a top surface of the ride plate via a plurality of resilient mounts At least one sealing member forms a seal between the portion of the jet pump and the portion of the front wall. The jet pump is mounted to the watercraft only via a plurality of mounting points. The jet pump is resiliently mounted to the watercraft via each of the plurality of mounting points.

18 Claims, 13 Drawing Sheets

SYSTEM FOR MOUNTING A MARINE JET PROPULSION SYSTEM

FIELD OF THE INVENTION

The present invention relates to systems for mounting marine jet propulsion systems on watercraft.

BACKGROUND OF THE INVENTION

Several different methods exist for propelling watercraft. Some watercraft are powered by what is known as a jet propulsion system which is driven by an engine of the watercraft. The jet propulsion system typically consists of a jet pump which pressurizes water from the body of water and expels it through a venturi as a jet rearwardly of the watercraft to create thrust. Usually, a steering nozzle is pivotally mounted rearwardly of the venturi. The steering nozzle is operatively connected to a steering assembly of the watercraft which causes it to turn left or right to redirect the jet of water and thereby steer the watercraft.

The jet propulsion system is usually disposed at least in part within a tunnel formed in the rear portion of the hull. The tunnel has front, left, right and top walls formed by the hull and is open at the bottom and at the transom. The front of a jet pump of the jet propulsion system is rigidly mounted to the front wall of the tunnel. The bottom of the tunnel is at least partially closed by a ride plate. The ride plate creates a surface on which the watercraft rides or planes at high speeds.

The jet pump includes a rotor that rotates at high speeds when the watercraft is in operation, thereby creating torsional and axial vibrations, as well as noise. These vibrations are transmitted through the hull to the hands and feet of the riders, and can cause discomfort or reduce the enjoyment of operating the watercraft.

In addition, the front wall of the tunnel must be of a sturdy construction to withstand the vibrations, and may have to be constructed separately from the rest of the hull. The ride plate, which is also situated at the rear of the watercraft, must also be of a sturdy construction, because it is designed to support at least a portion of the weight of the watercraft during operation. The multiplicity of separately-constructed sturdy and heavy components that must be individually assembled to the watercraft results in increased weight and manufacturing cost.

Therefore, there is a need for a watercraft and a jet propulsion system for a watercraft which reduces the amount of vibrations transmitted from the jet propulsion system to the riders and to the hull and the deck.

SUMMARY OF THE INVENTION

It is an object of the present invention to ameliorate at least some of the inconveniences present in the prior art.

It is also an object of the present invention to provide a jet propulsion system for a watercraft which reduces the amount of vibrations transmitted from the jet propulsion system to the riders and to the hull.

It is another object of the present invention to provide a watercraft having the above jet propulsion system.

In one aspect, the invention provides a watercraft comprising a hull. A deck is disposed above the hull. An engine compartment is defined between the hull and the deck. An engine is disposed in the engine compartment. A ride plate is mounted below a rear portion of the hull. A steering assembly is disposed at least in part on the deck. A jet pump assembly is operatively connected to the engine for propelling the watercraft. The jet pump assembly includes a jet pump disposed at least in part between the ride plate and the hull. A front wall is formed at least in part by the hull and disposed forwardly of the jet pump. The jet pump assembly is mounted on a top surface of the ride plate via a plurality of resilient mounts disposed between the ride plate and the jet pump assembly. The jet pump assembly and the front wall have a space therebetween and at least one sealing member disposed in the space. The at least one sealing member forms a seal between the portion of the jet pump and the portion of the front wall.

In a further aspect, the plurality of resilient mounts includes a pair of front resilient mounts and a pair of rear resilient mounts.

In a further aspect, the jet pump assembly is disposed laterally inwardly of at least one pair of the resilient mounts.

In a further aspect, the pair of rear resilient mounts are disposed laterally inwardly of the pair of front resilient mounts.

In a further aspect, the pair of front resilient mounts are disposed forwardly of a center of gravity of the jet pump assembly. The pair of rear resilient mounts are disposed rearwardly of the center of gravity of the jet pump assembly.

In a further aspect, at least one resilient bumper is disposed between the jet pump assembly and the front wall.

In a further aspect, the at least one resilient bumper is a dual compound bumper comprising a first resilient material having a first durometer hardness and a second resilient material having a second durometer hardness greater than the first durometer hardness.

In a further aspect, each resilient mount has a first side mounted to the jet pump. A second side is mounted to the ride plate. The first side has a first upper edge and a first lower edge. The first lower edge is disposed forwardly and downwardly of the first upper edge. The second side has a second upper edge and a second lower edge. The second lower edge is disposed forwardly and downwardly of the second upper edge.

In a further aspect, each resilient mount includes a resilient member having a first side. A second side is generally opposite the first side. A metal plate is bonded to the first side. The metal plate has a thread formed therein for receiving a bolt. A metal mount is bonded to the second side. The resilient mount is fastened to the jet pump assembly via the metal plate. The resilient mount is fastened to the ride plate via the metal mount.

In a further aspect, each resilient member is frusto-conical.

In a further aspect, each metal mount has a backing plate extending generally parallel to a longitudinal axis of a corresponding resilient member. The backing plate is spaced apart from the resilient member.

In an additional aspect, the invention provides a watercraft comprising a hull. A deck is disposed above the hull. An engine compartment is defined between the hull and the deck. An engine is disposed in the engine compartment. A ride plate is mounted below a rear portion of the hull. A steering assembly is disposed at least in part on the deck. A jet pump assembly is operatively connected to the engine for propelling the watercraft. The jet pump assembly includes a jet pump disposed at least in part between the ride plate and the hull and mounted to the watercraft only via a plurality of mounting points. The jet pump is resiliently mounted to the watercraft via each of the plurality of mounting points.

In a further aspect, the plurality of mounting points includes a pair of front mounting points having front resilient mounts and a pair of rear mounting points having rear resilient mounts. The jet pump is mounted on a top surface of the ride plate via the pair of front resilient mounts and the pair of rear resilient mounts.

In a further aspect, the pair of rear resilient mounts are disposed laterally inwardly of the pair of front resilient mounts.

In a further aspect, the pair of front resilient mounts are disposed forwardly of a center of gravity of the jet pump assembly. The pair of rear resilient mounts are disposed rearwardly of the center of gravity of the jet pump assembly.

In a further aspect, a front wall is formed at least in part by the hull and disposed forwardly of the jet pump. The plurality of mounting points includes at least one resilient bumper disposed between the jet pump assembly and the front wall.

In a further aspect, the at least one resilient bumper is a dual compound bumper comprising a first resilient material having a first durometer hardness and a second resilient material having a second durometer hardness greater than the first durometer hardness.

In a further aspect, each of the pair of front resilient mounts and the pair of rear resilient mounts has a first side mounted to the jet pump. A second side is mounted to the ride plate. The first side has a first upper edge and a first lower edge. The first lower edge is disposed forwardly and downwardly of the first upper edge. The second side has a second upper edge and a second lower edge. The second lower edge is disposed forwardly and downwardly of the second upper edge.

In a further aspect, each of the pair of front resilient mounts and the pair of rear resilient mounts includes a resilient member having a first side. A second side is generally opposite the first side. A metal plate is bonded to the first side. The metal plate has a thread formed therein for receiving a bolt. A metal mount is bonded to the second side. The resilient mount is fastened to the jet pump assembly via the metal plate. The resilient mount is fastened to the ride plate via the metal mount.

In a further aspect, each resilient member is frusto-conical.

In a further aspect, each metal mount has a backing plate extending generally parallel to a longitudinal axis of a corresponding resilient member. The backing plate is spaced apart from the resilient member.

For purposes of this application, terms related to spatial orientation such as forwardly, rearwardly, left, and right, are as they would normally be understood by a driver of the watercraft sitting thereon in a normal driving position. It should be understood that terms related to spatial orientation when referring to the jet propulsion system alone should be understood as they would normally be understood when the jet propulsion system is installed on a watercraft.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described with respect to a personal watercraft. However, it should be understood that other types of watercraft are contemplated, such as a jet boat.

The general construction of a personal watercraft 10 in accordance with this invention will be described with respect to FIGS. 1-5. The following description relates to one way of manufacturing a personal watercraft. Obviously, those of ordinary skill in the watercraft art will recognize that there are other known ways of manufacturing and designing watercraft and that this invention would encompass other known ways and designs.

Figure 1:
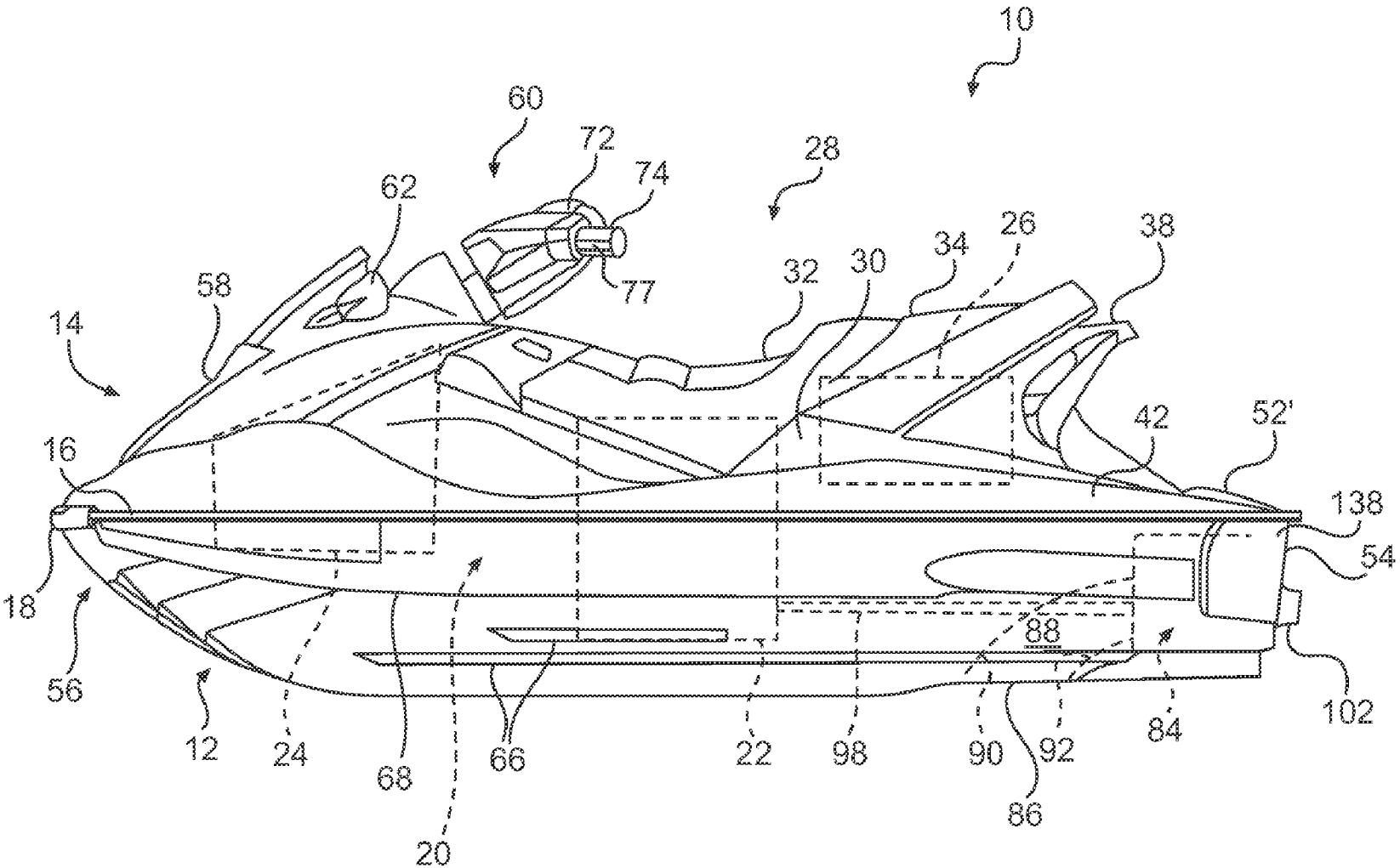
FIG. 1 illustrates a side view of a personal watercraft in accordance with the invention.

The watercraft 10 of FIG. 1 is made of two main parts, including a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow 56, as shown, or around any portion or all of the seam 16.

The space between the hull 12 and the deck 14 forms a volume commonly referred to as the engine compartment 20 (shown in phantom). Shown schematically in FIG. 1, the engine compartment 20 accommodates an engine 22, as well as a muffler, tuning pipe, gas tank, electrical system (battery, electronic control unit, etc.), air box, storage bins 24, 26, and other elements required or desirable in the watercraft 10.

Figure 2:
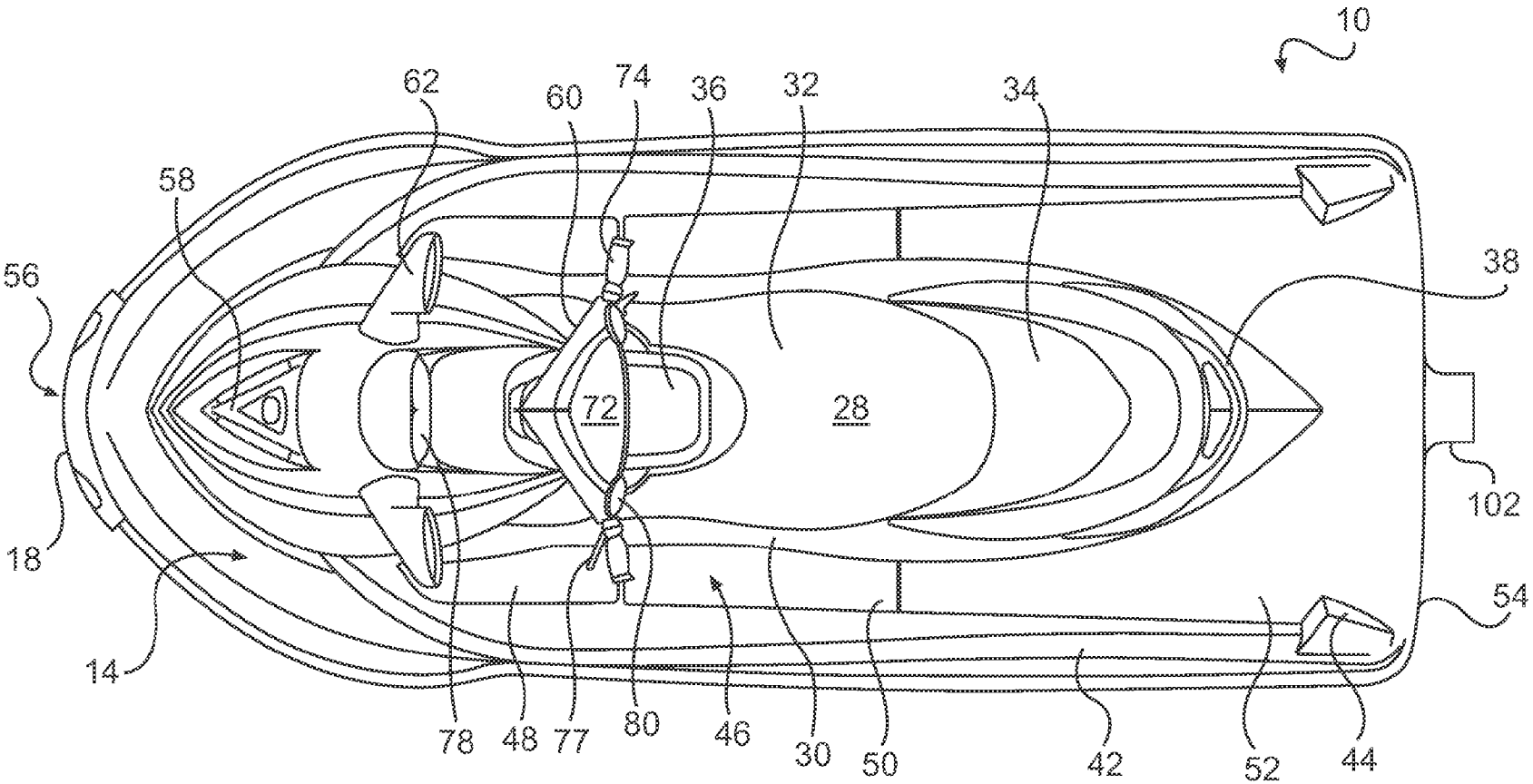
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 is sized to accommodate one or more riders. As seen in FIG. 2, the seat 28 includes a first, front seat portion 32 and a rear, raised seat portion 34 that accommodates a passenger. The seat 28 is preferably made as a cushioned or padded unit or interfitting units. The first and second seat portions 32, 34 are removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) covers a removable storage box 26 (FIG. 1). A "glove compartment" or small storage box 36 is provided in front of the seat 28.

Figure 4:
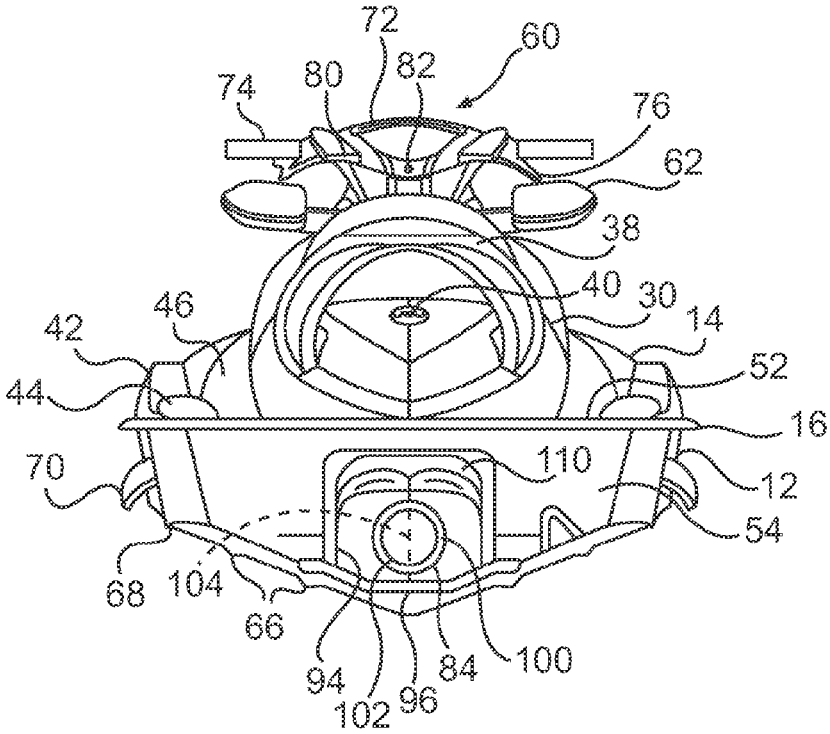
FIG. 4 is a back view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the rider could be used. The footrests 46 are covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
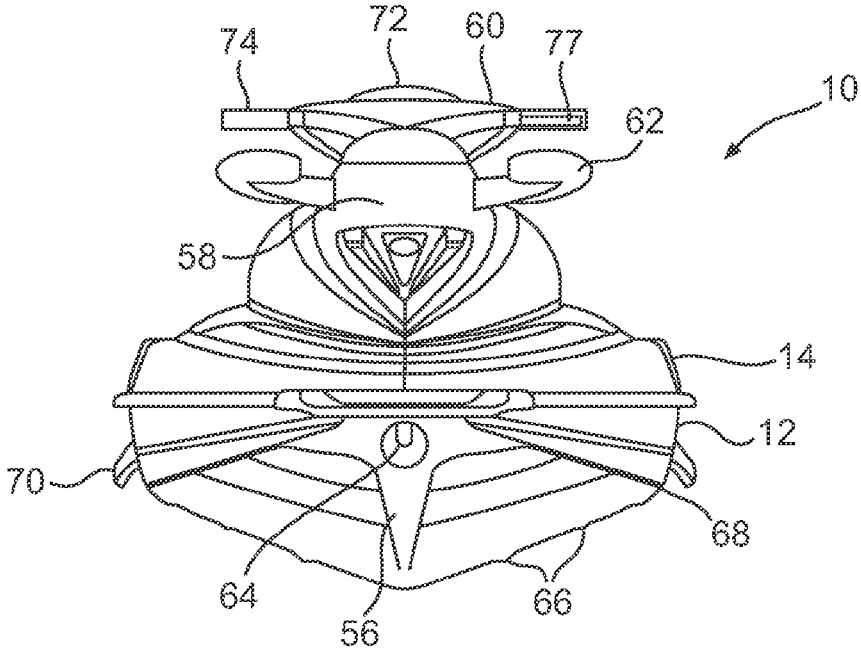
FIG. 3 is a front view of the watercraft of FIG. 1.

Referring to the bow 56 of the watercraft 10, as seen in FIGS. 2 and 3, watercraft 10 is provided with a hood 58 located forwardly of the seat 28 and a steering assembly including a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft is not in use or to attach to a winch when loading the watercraft 10 on a trailer, for instance.

Figure 5:
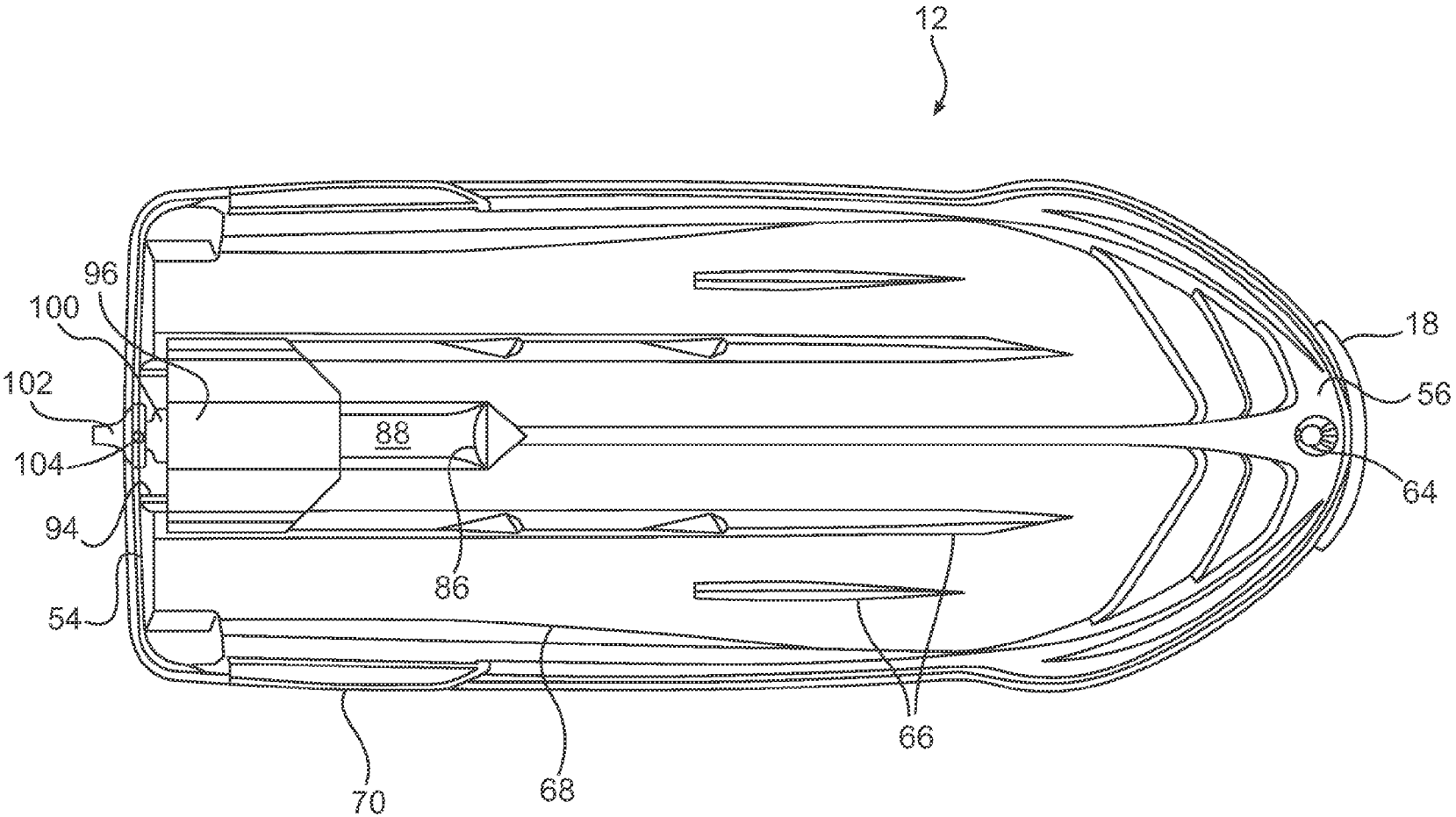
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 preferably have an arcuate undersurface that gives the watercraft 10 both lift while in motion and improved turning characteristics. The sponsons 70 are preferably fixed to the surface of the hull 12 and can be attached to the hull by fasteners or molded therewith. Sometimes it may be desirable to adjust the position of the sponson 70 with respect to the hull 12 to change the handling characteristics of the watercraft 10 and accommodate different riding conditions.

As best seen in FIGS. 3 and 4, the helm assembly 60 is positioned forwardly of the seat 28. The helm assembly 60 has a central helm portion 72, that may be padded, and a pair of steering handles 74, also referred to as a handlebar. One of the steering handles 74 is preferably provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. The throttle operator 76 is preferably biased towards the idle position, such that when the driver of the watercraft lets go of the throttle operator 76, it will move to the idle position. The other of the steering handles 74 may be provided with a lever 77 used by the driver to control the jet propulsion system 84.

As seen in FIG. 2, a display area or cluster 78 is located forwardly of the helm assembly 60. The display cluster 78 can be of any conventional display type, including a liquid crystal display (LCD), dials or LED (light emitting diodes). The central helm portion 72 has various buttons 80, which could alternatively be in the form of levers or switches, that allow the rider to modify the display data or mode (speed, engine rpm, time . . . ) on the display cluster 78. Buttons 80 may also used by the driver to control the jet propulsion system 84.

The helm assembly 60 also has a key receiving post 82, preferably located near a center of the central helm portion 72. The key receiving post 82 is adapted to receive a key (not shown) for starting the watercraft 10. As is known, the key is typically attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84. As known, the jet propulsion system 84 pressurizes water to create thrust. The water is first scooped from under the hull 12 through an inlet 86, which preferably has a grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

Figure 8:
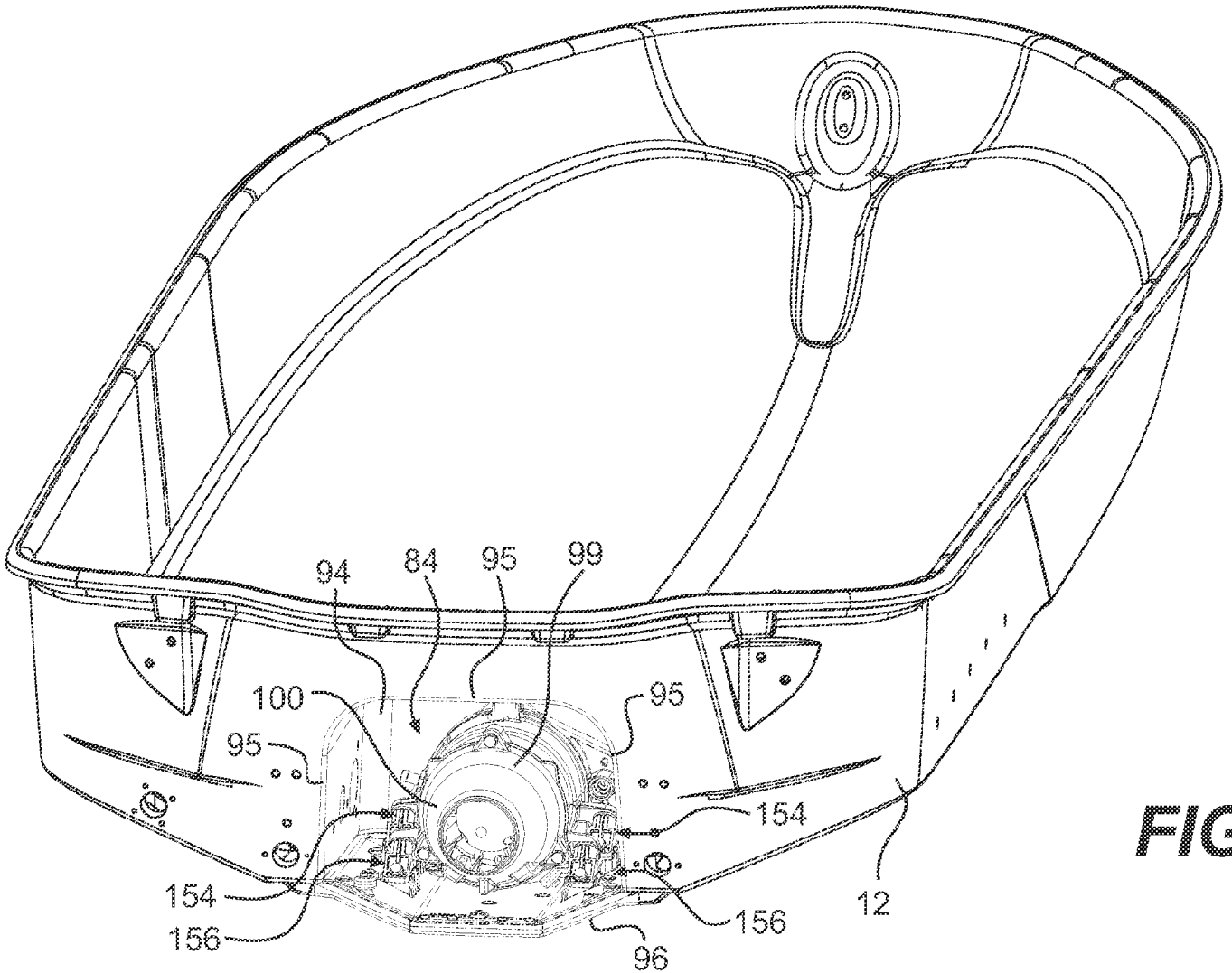
FIG. 8 is a perspective view, taken from a rear, right side, of the hull of the watercraft of FIG. 1.
Figure 9:
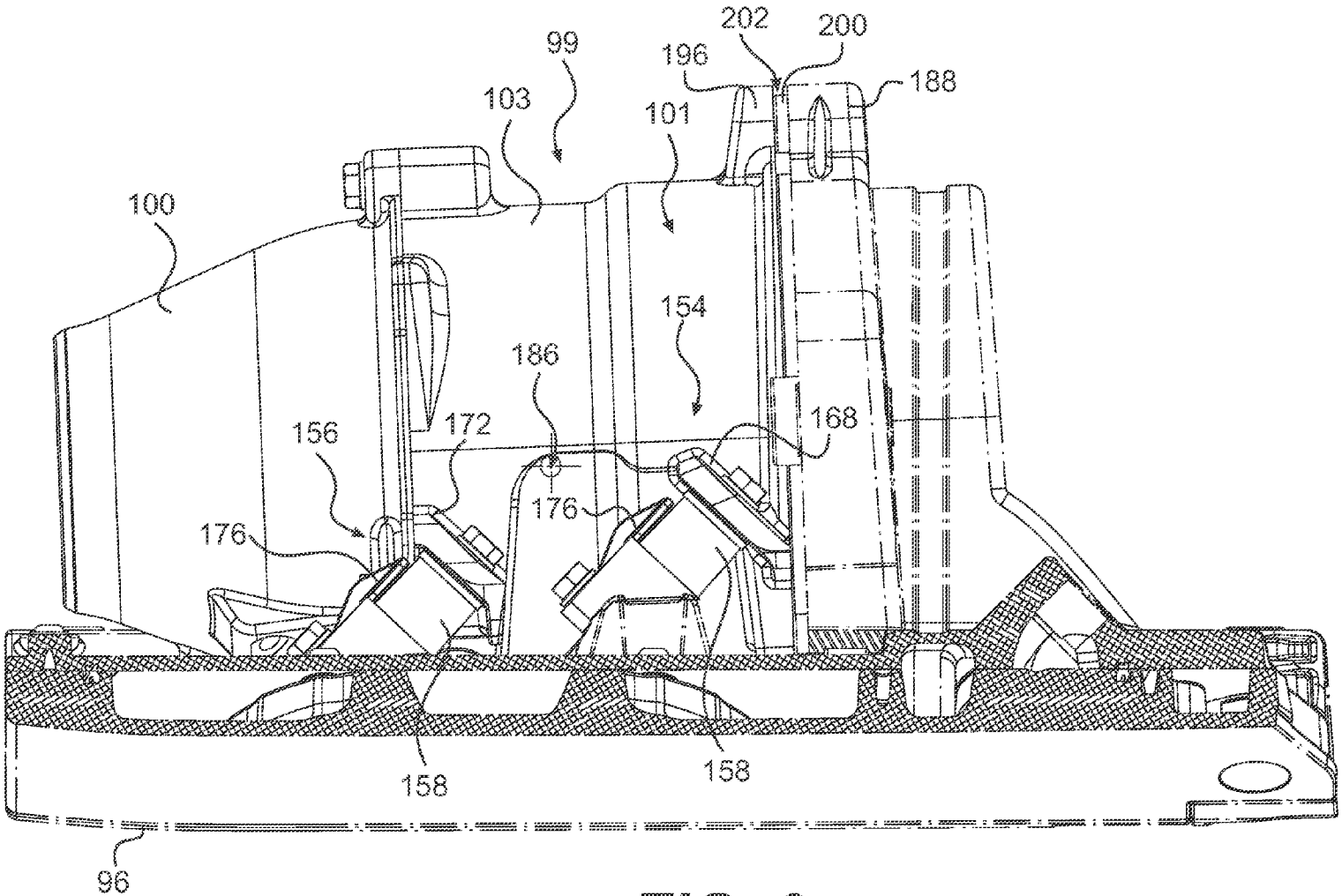
FIG. 9 is a right side elevation view of a jet pump assembly for powering the watercraft of FIG. 1 or the jet boat of FIG. 6.

From the intake ramp 88, water enters the jet propulsion system 84. As seen in FIG. 8, the jet propulsion system 84 is located in a formation in the hull 12, referred to as the tunnel 94. The tunnel 94 is defined at the front, sides, and top by walls 95 formed by the hull 12 (see FIG. 9) and is open at the transom 54. The bottom of the tunnel 94 is closed by a ride plate 96. The ride plate 96 creates a surface on which the watercraft 10 rides or planes at high speeds. The jet propulsion system 84 is mounted to the ride plate 96 in a manner that will be described in further detail below. This configuration reduces the projection of the jet propulsion system 84 from the back of the watercraft 10.

The jet propulsion system 84 includes a jet pump 99. The forward end of the jet pump 99 is connected to the front wall 95 of the tunnel 94. The jet pump includes an impeller 101 (best seen in FIG. 10) and a stator 103 (best seen in FIG. 10). The impeller 101 is coupled to the engine 22 by one or more shafts 98, such as a driveshaft and an impeller shaft. The rotation of the impeller 101 pressurizes the water, which then moves over the stator 103 that is made of a plurality of fixed stator blades 105 (best seen in FIG. 10). The role of the stator blades 105 is to decrease the rotational motion of the water so that almost all the energy given to the water is used for thrust, as opposed to swirling the water. Once the water leaves the jet pump 99, it goes through a venturi 100 that is connected to the rearward end of the jet pump 99. Since the venturi's exit diameter is smaller than its entrance diameter, the water is accelerated further, thereby providing more thrust.

A steering nozzle 102 (FIG. 5) is rotationally mounted relative to the venturi 100, so as to pivot about a steering axis 104. The steering nozzle 102 is operatively connected to the helm assembly 60 preferably via a push-pull cable (not shown) such that when the helm assembly 60 is turned, the steering nozzle 102 pivots about the steering axis 104. This movement redirects the pressurized water coming from the venturi 100, so as to redirect the thrust and steer the watercraft 10 in the desired direction. The jet pump 99, the venturi 100 and the steering nozzle 102 together form a jet pump assembly. It is contemplated that the jet pump assembly may alternatively have no steering nozzle 102, in which case an alternative means may be provided for steering the watercraft 10. For example, the watercraft 10 may alternatively be steered by one or more rudders, or by having two laterally spaced jet pump assemblies that are selectively powered to steer the watercraft 10 in the desired direction. The jet pump assembly is disposed in the tunnel 94 and mounted on the ride plate 96 as will be described in further detail below.

The jet propulsion system 84 is provided with a reverse gate 110 (FIG. 4) which is movable between a stowed position where it does not interfere with a jet of water being expelled by the steering nozzle 102 and one or more positions where it redirects the jet of water being expelled by the steering nozzle 102 in a known manner.

When the watercraft 10 is moving, its speed is measured by a speed sensor (not shown) attached to the transom 54 of the watercraft 10. The speed sensor has a paddle wheel that is turned by the water flowing past the hull 12. In operation, as the watercraft 10 goes faster, the paddle wheel turns faster in correspondence. An electronic control unit (ECU) (not shown) connected to the speed sensor converts the rotational speed of the paddle wheel to the speed of the watercraft 10 in kilometers or miles per hour, depending on the rider's preference. The speed sensor may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

Figure 6:
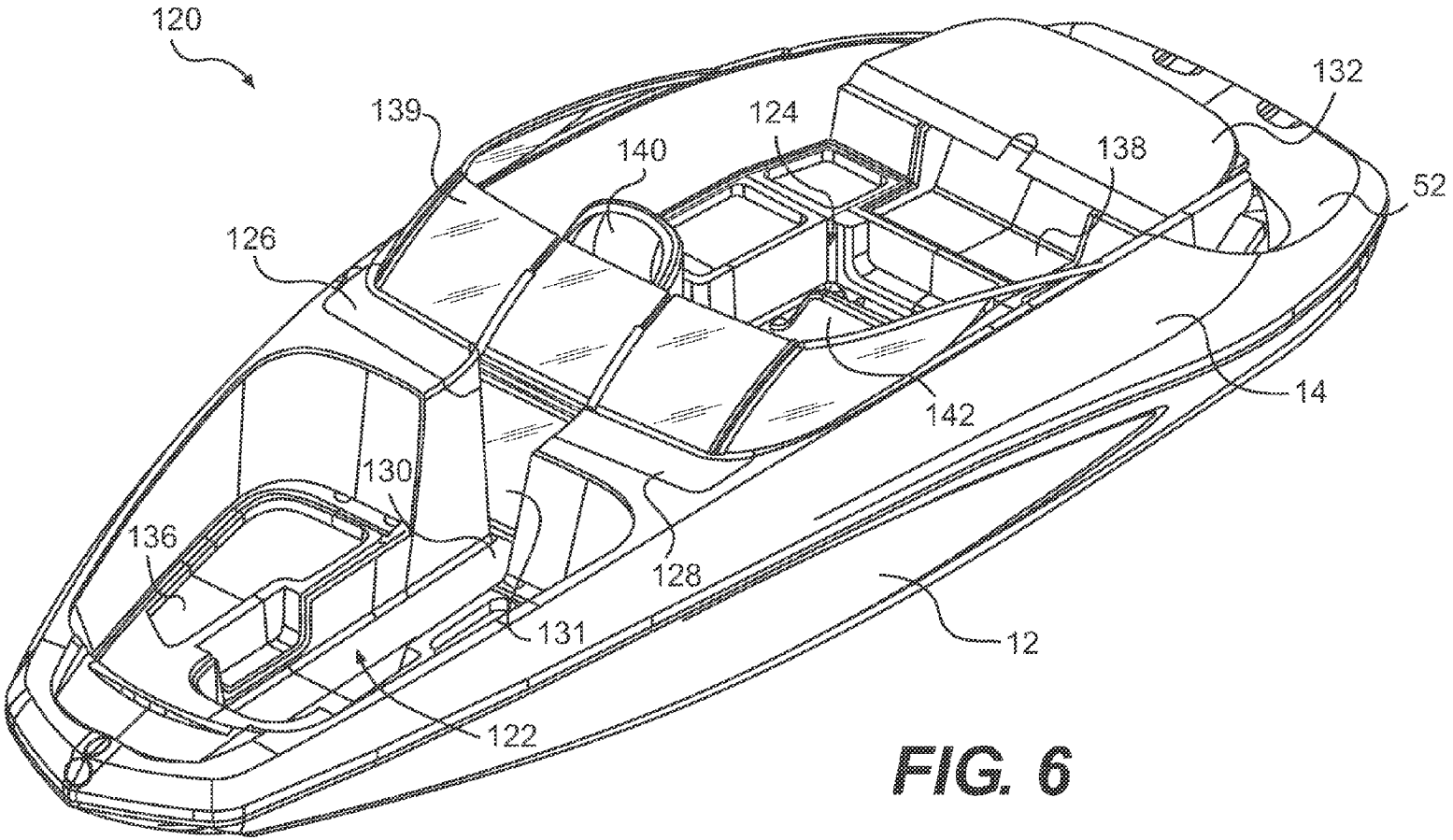
FIG. 6 is a perspective view, taken from a front, left side, of a jet boat.
Figure 7:
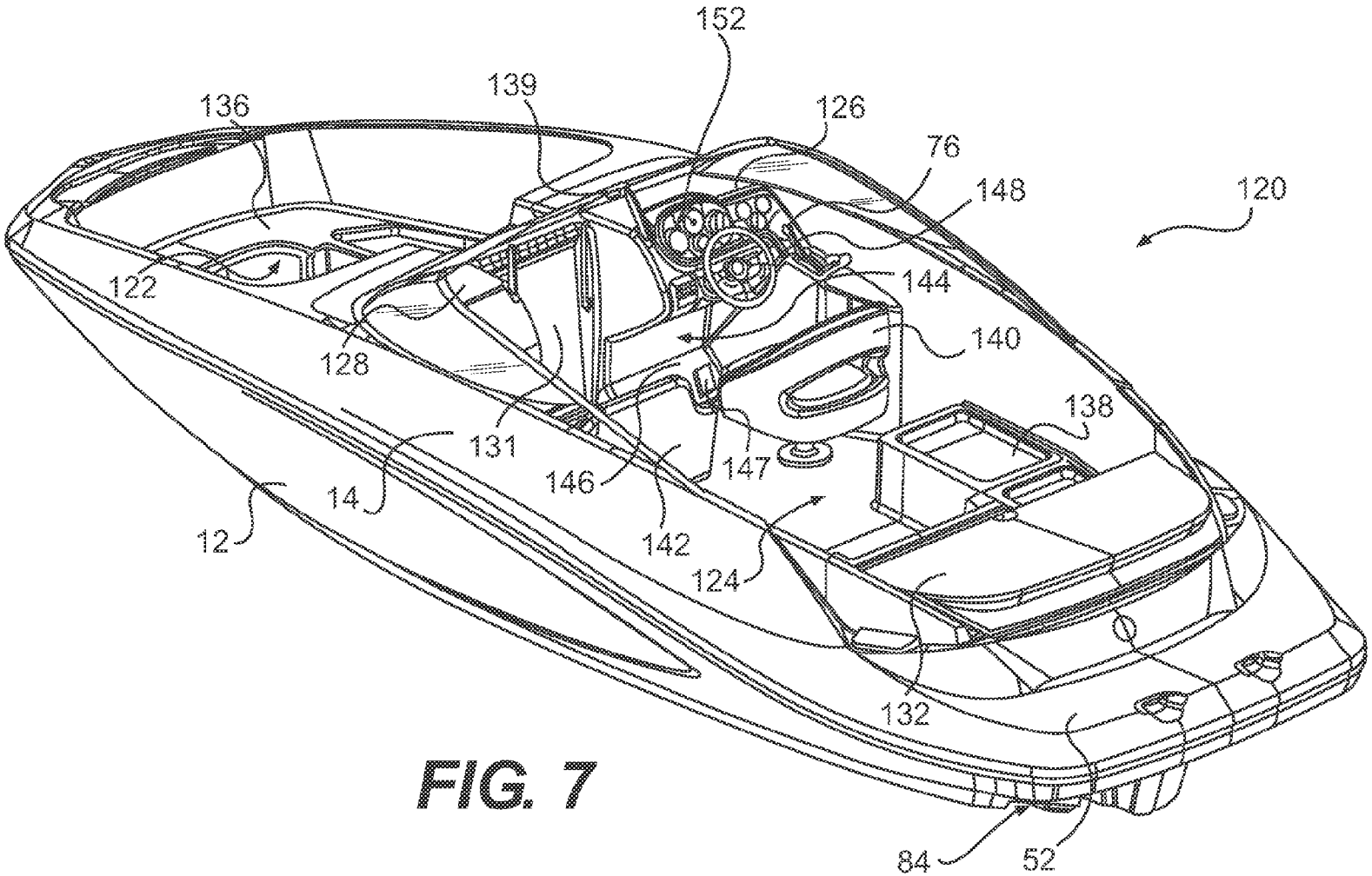
FIG. 7 is a perspective view, taken from a rear, left side, of the jet boat of FIG. 6.

The general construction of a jet boat 120 in accordance with this invention will now be described with respect to FIGS. 6 and 7. The following description relates to one way of manufacturing a jet boat. Obviously, those of ordinary skill in the jet boat art will recognize that there are other known ways of manufacturing and designing jet boats and that this invention would encompass other known ways and designs.

For simplicity, the components of the jet boat 120 which are similar in nature to the components of the personal watercraft 10 described above will be given the same reference numeral. It should be understood that their specific construction may vary however.

The jet boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. A reboarding platform 52 is located at the back of the deck 14 for passengers to easily reboard the boat 120 from the water. At least one engine (not shown) is located between the hull 12 and the deck 14 at the back of the boat 120. The engine powers the jet propulsion system 84 of the boat 120. The jet propulsion system 84 is of similar construction as the jet propulsion system 84 of the personal watercraft 10 described above, and will therefore not be described in detail here. It is contemplated that the boat 120 could have two engines and two jet propulsion systems 84. The jet propulsion system 84 is located on the transom of the hull 12. Unlike the watercraft 10 of FIG. 1, the boat 120 does not have a tunnel formed in the hull 12. The projection of the jet propulsion system 84 from the back of the boat 120 is not a major concern due to the size of the reboarding platform 52. The engine is accessible through an engine cover 132 located behind the rearward passenger area 124. The engine cover 132 can also be used as a sundeck for a passenger of the boat 120 to sunbathe on while the boat 120 is not in motion.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 can swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A foot pedal 147 is provided on the footrest 146 which may be used to control the jet propulsion system 84. The left console 128 has a similar recess (not shown) to accommodate the feet of the passenger sitting in the passenger seat 142. The right console 126 accommodates all of the elements necessary to the driver to operate the boat 120. These include, but are not limited to, a steering assembly including a steering wheel 148, a throttle operator 76 in the form of a throttle lever, and an instrument panel 152. The instrument panel 152 has various dials indicating the watercraft speed, engine speed, fuel and oil level, and engine temperature. The speed of the watercraft is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Turning now to FIGS. 8 to 14 the mounting of the jet pump assembly to the ride plate 96 of the watercraft 10 will be described. It should be understood that the jet pump assembly could be mounted to the jet boat 120 in a similar manner.

Figure 13:
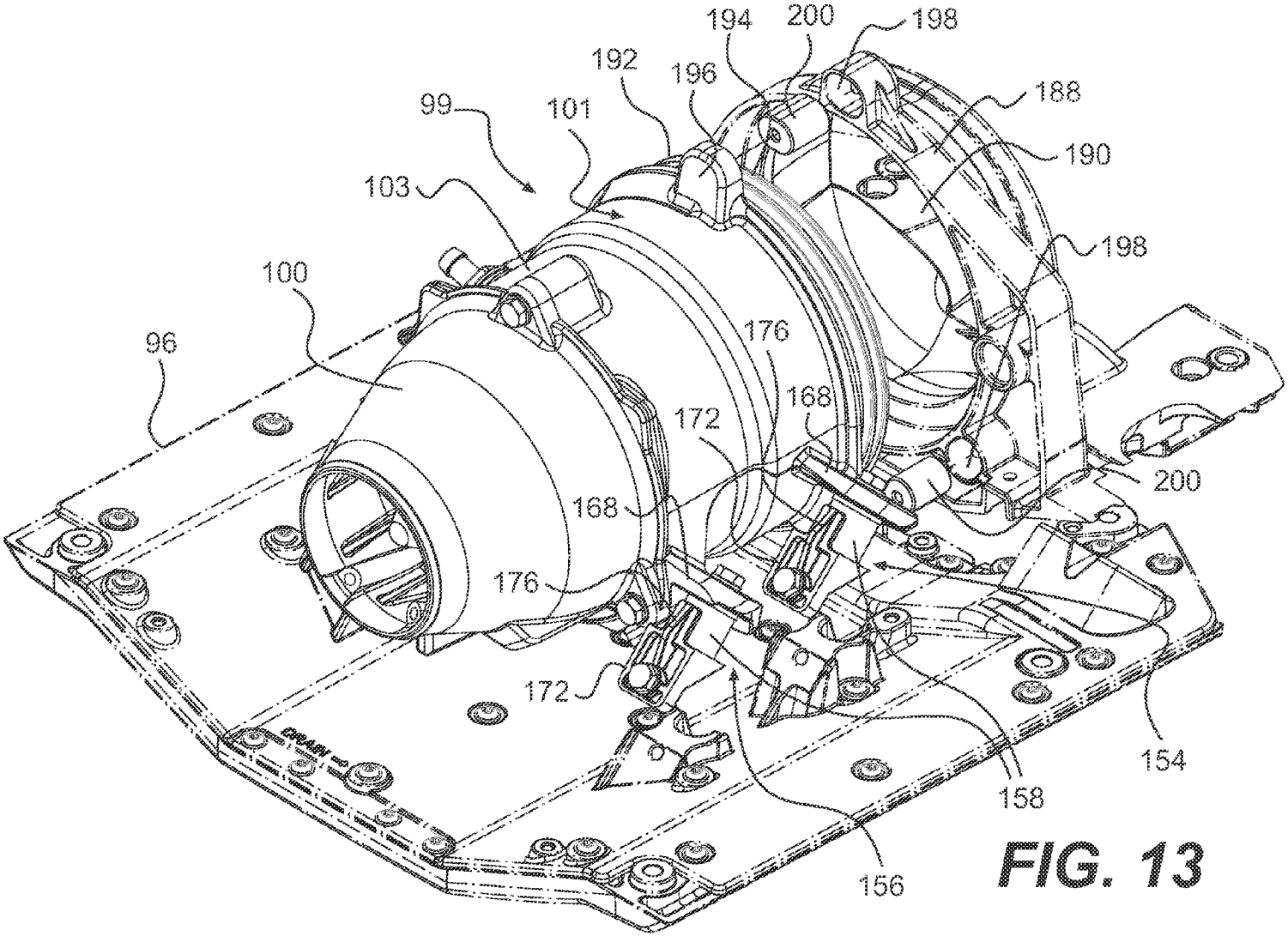
FIGS. 13 and 14 are perspective views, taken from a rear, right side, of the jet pump assembly of FIG. 9, respectively showing the jet pump assembly detached from and connected to a ride plate.
Figure 14:
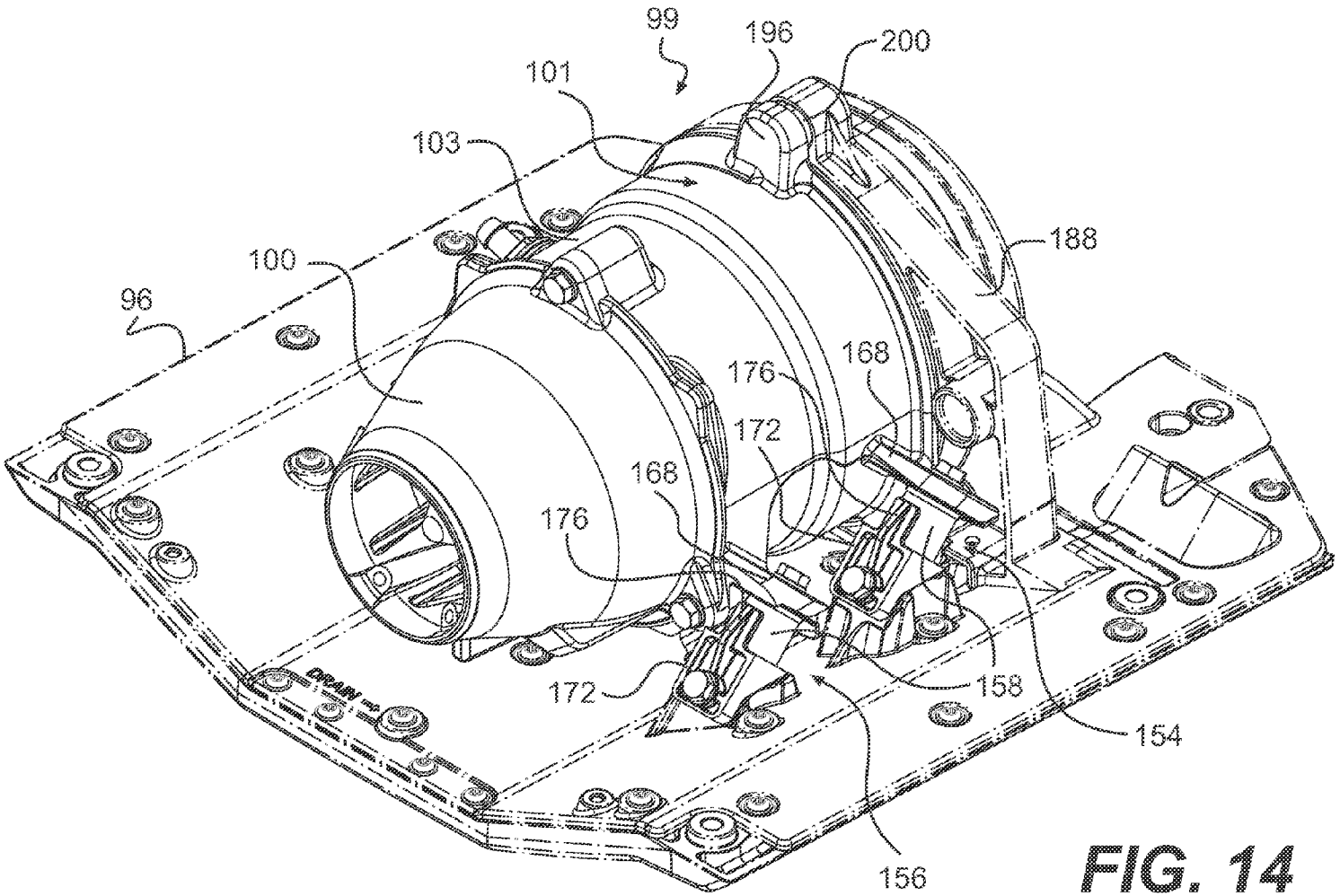
Figure 1:
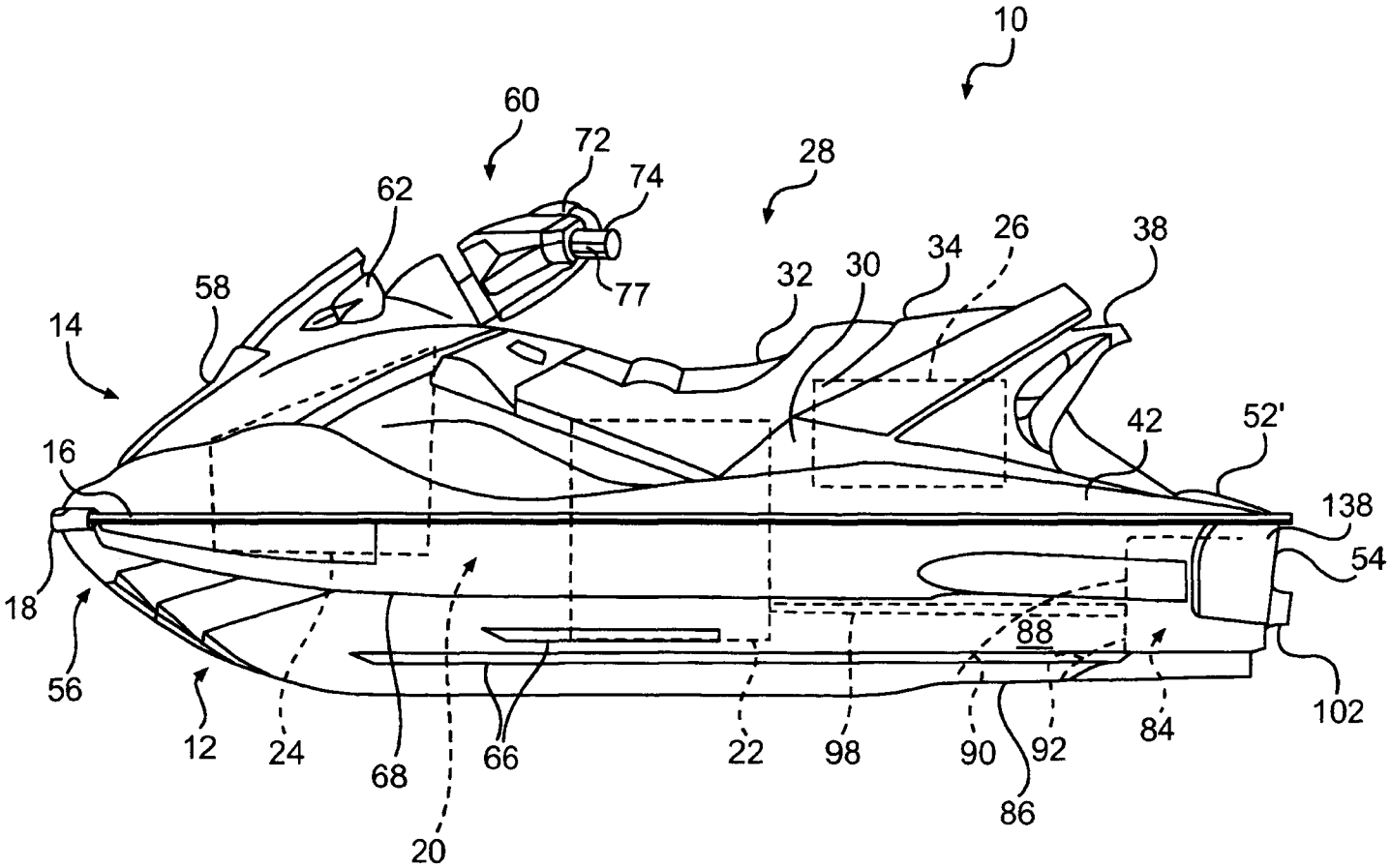
Figure 2:
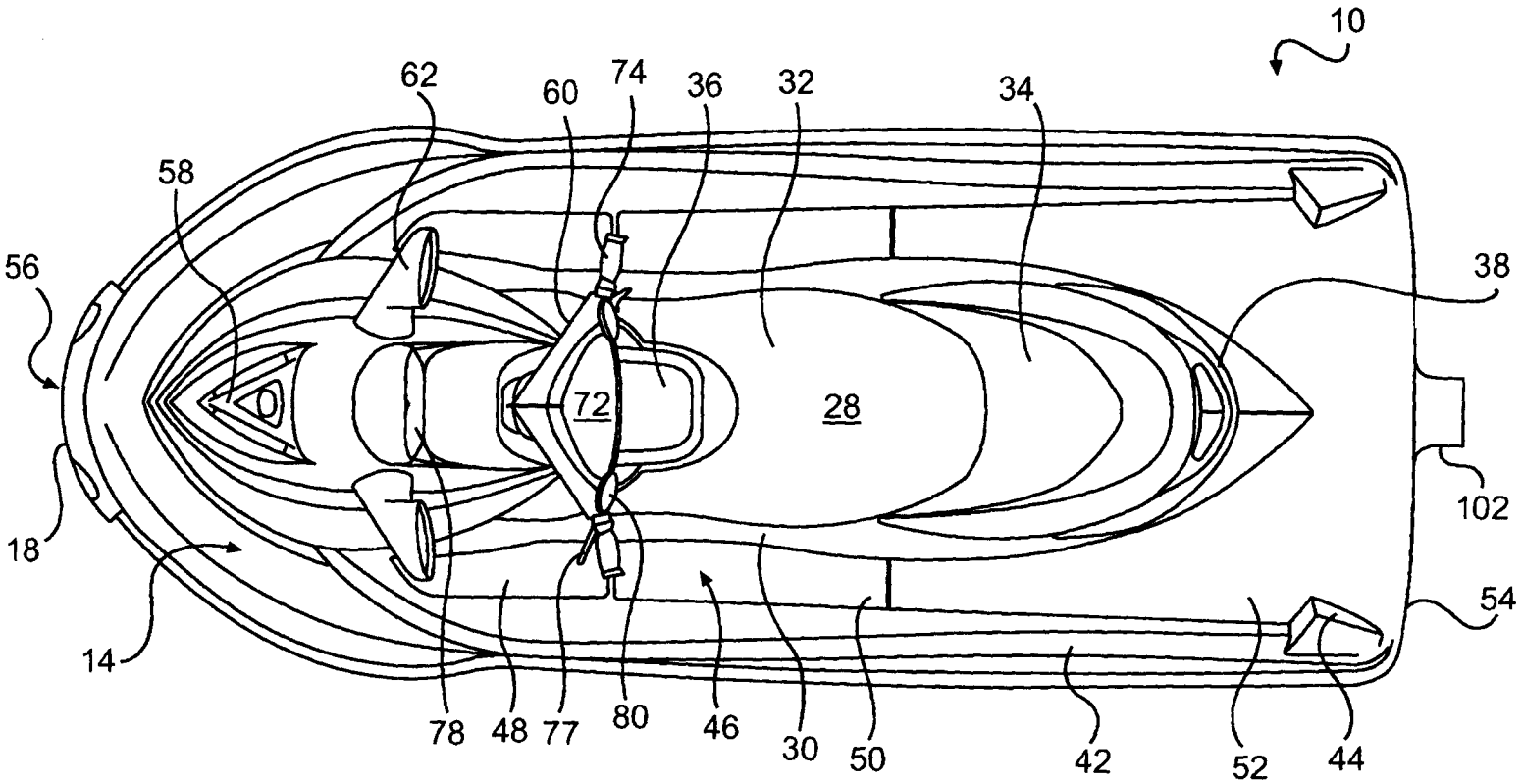
Figure 3:
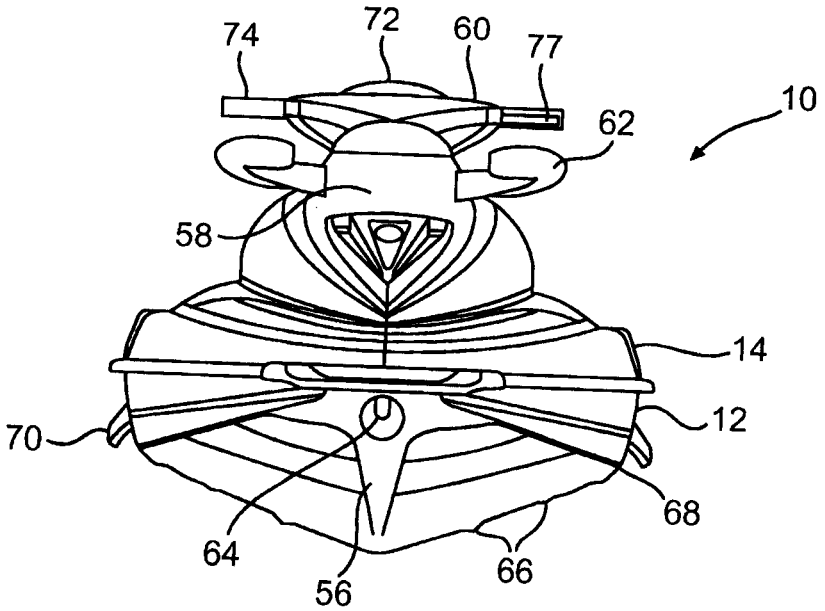
Figure 4:
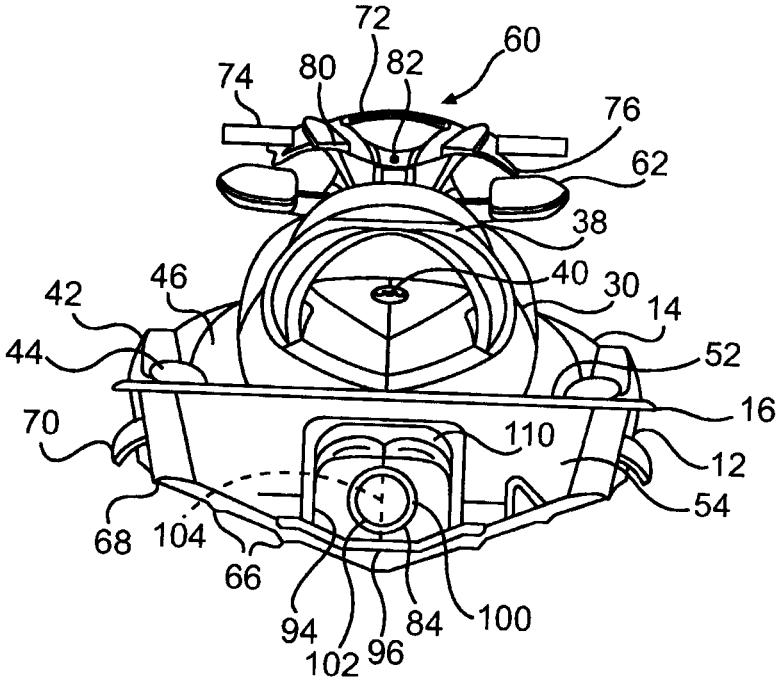
Figure 5:
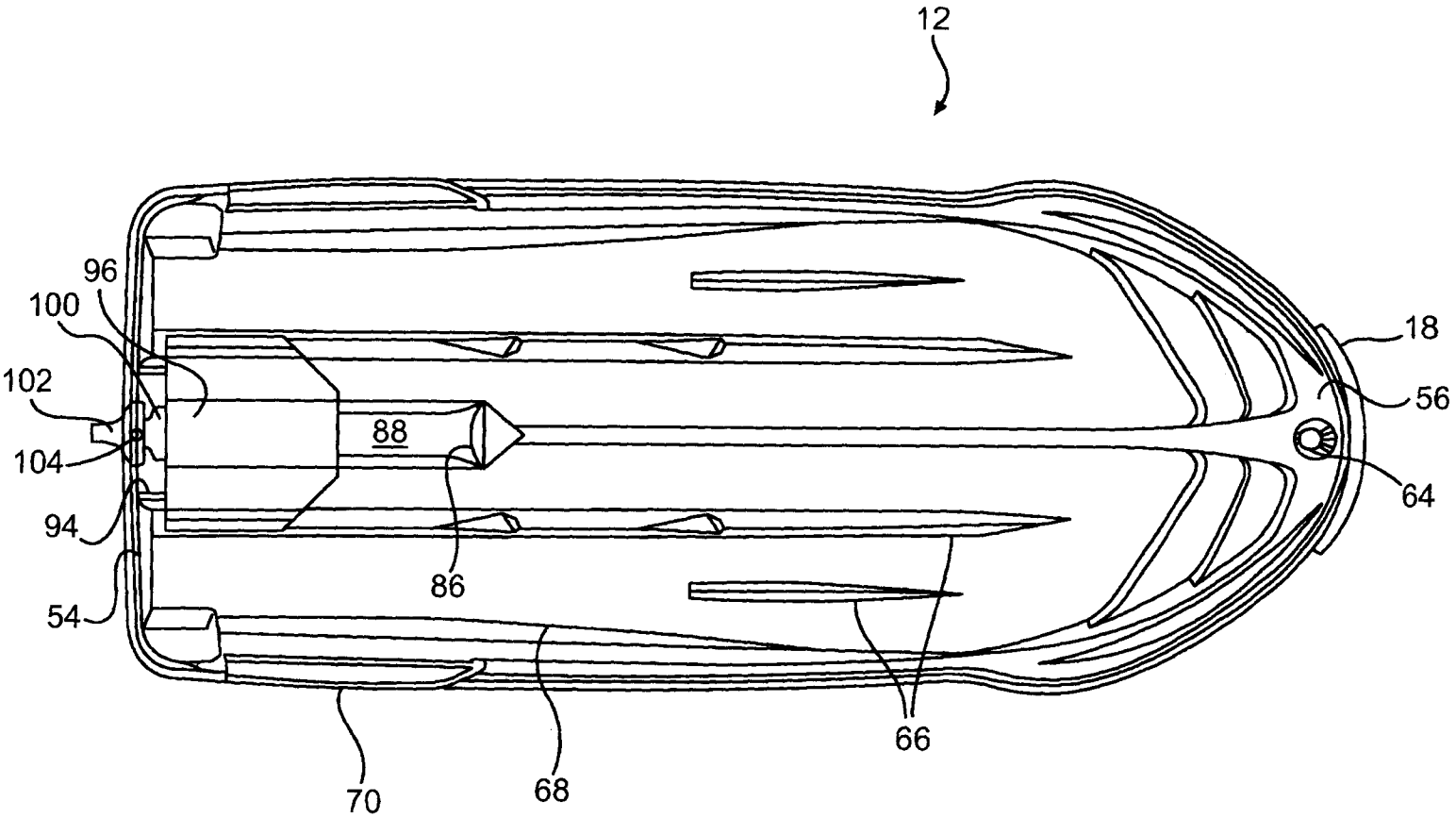
Figure 6:
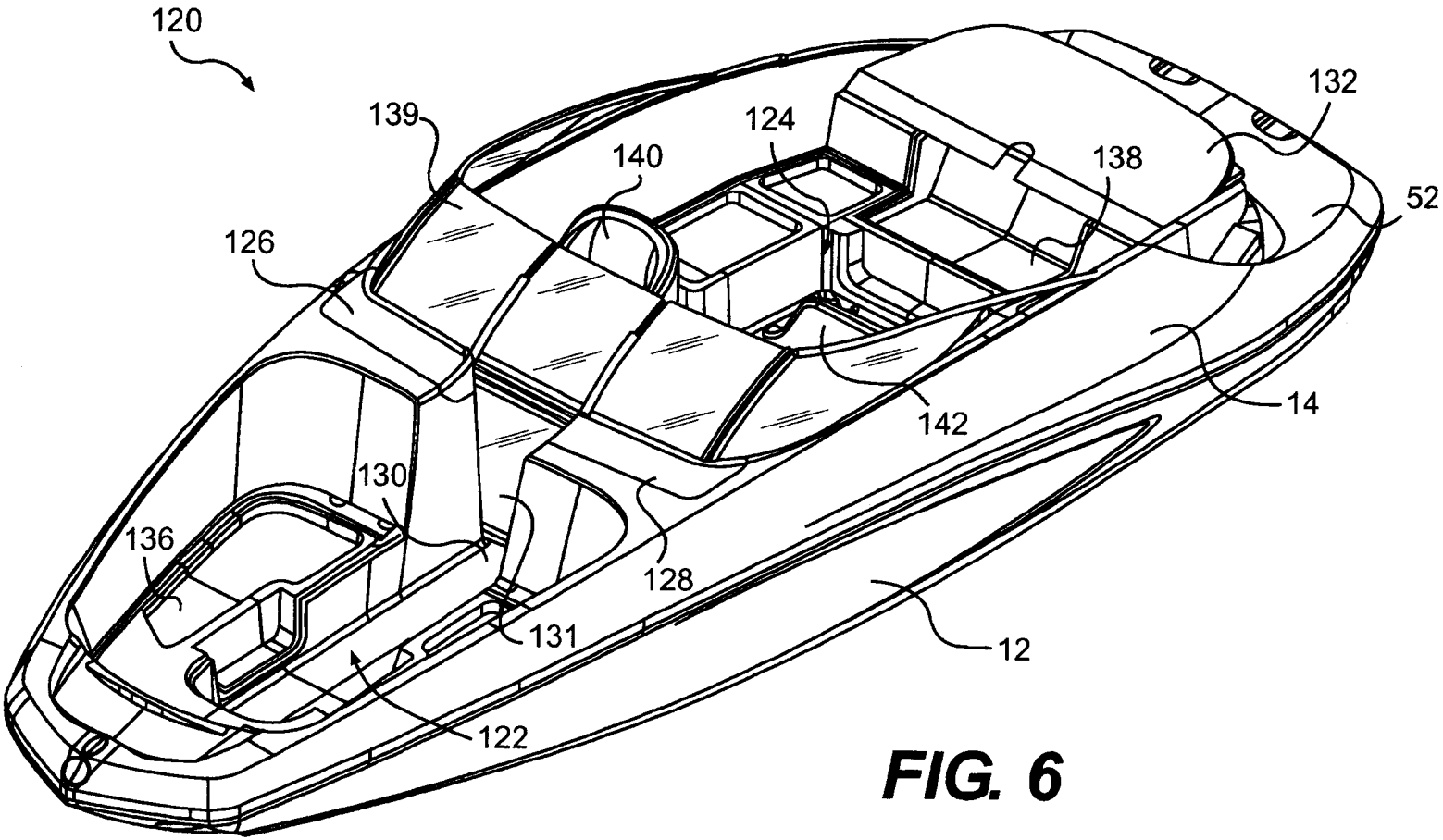
Figure 7:
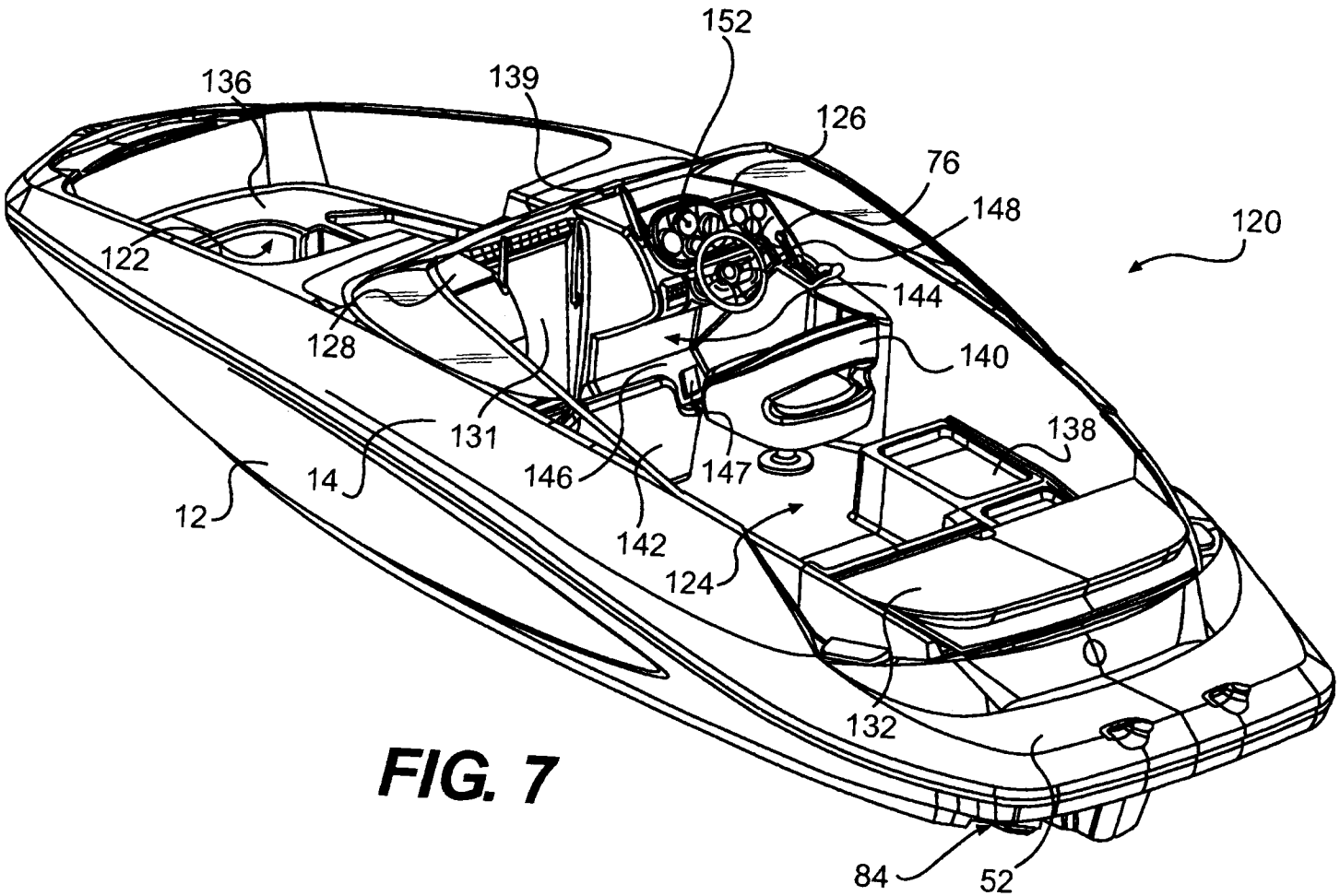
Figure 8:
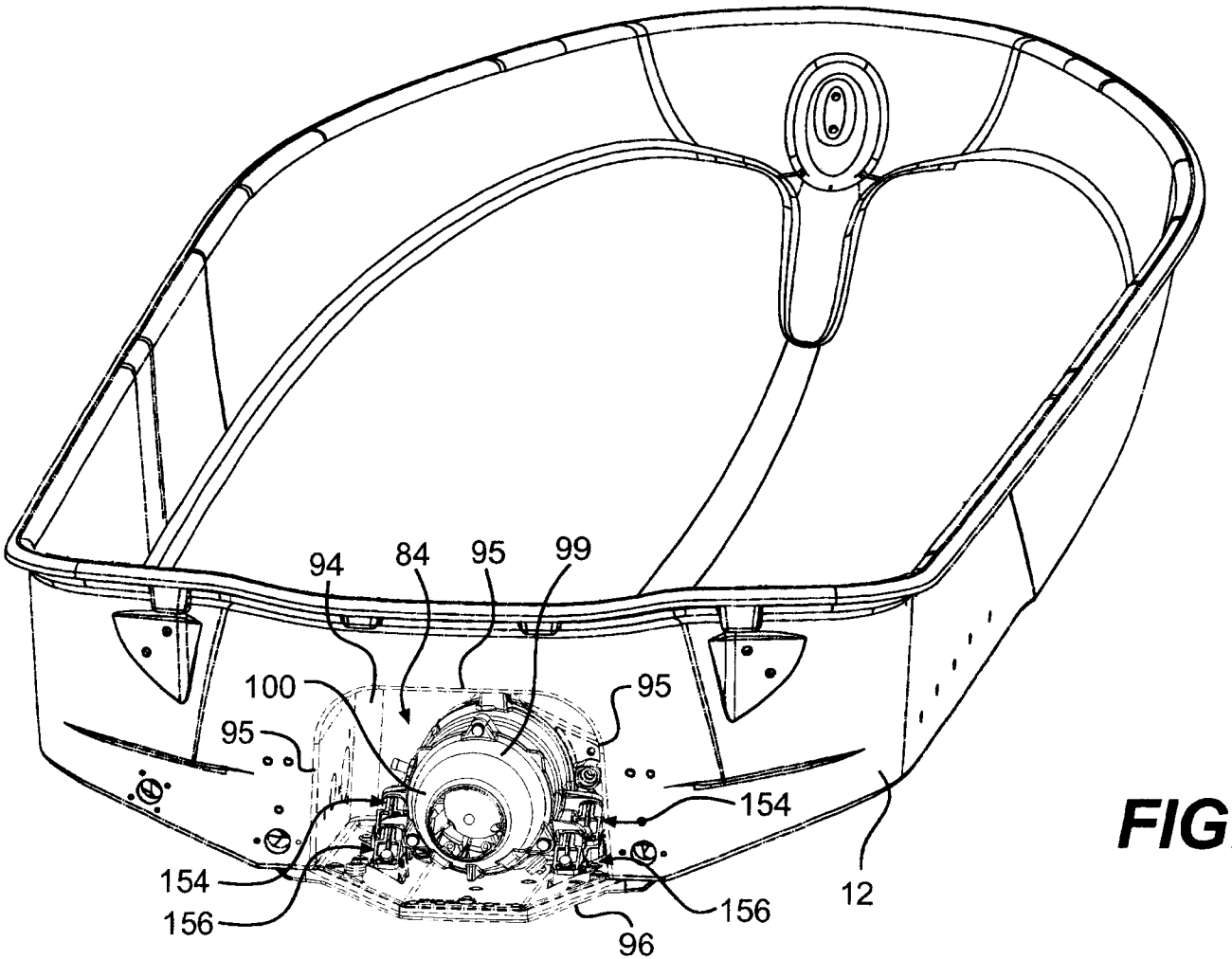
Figure 9:
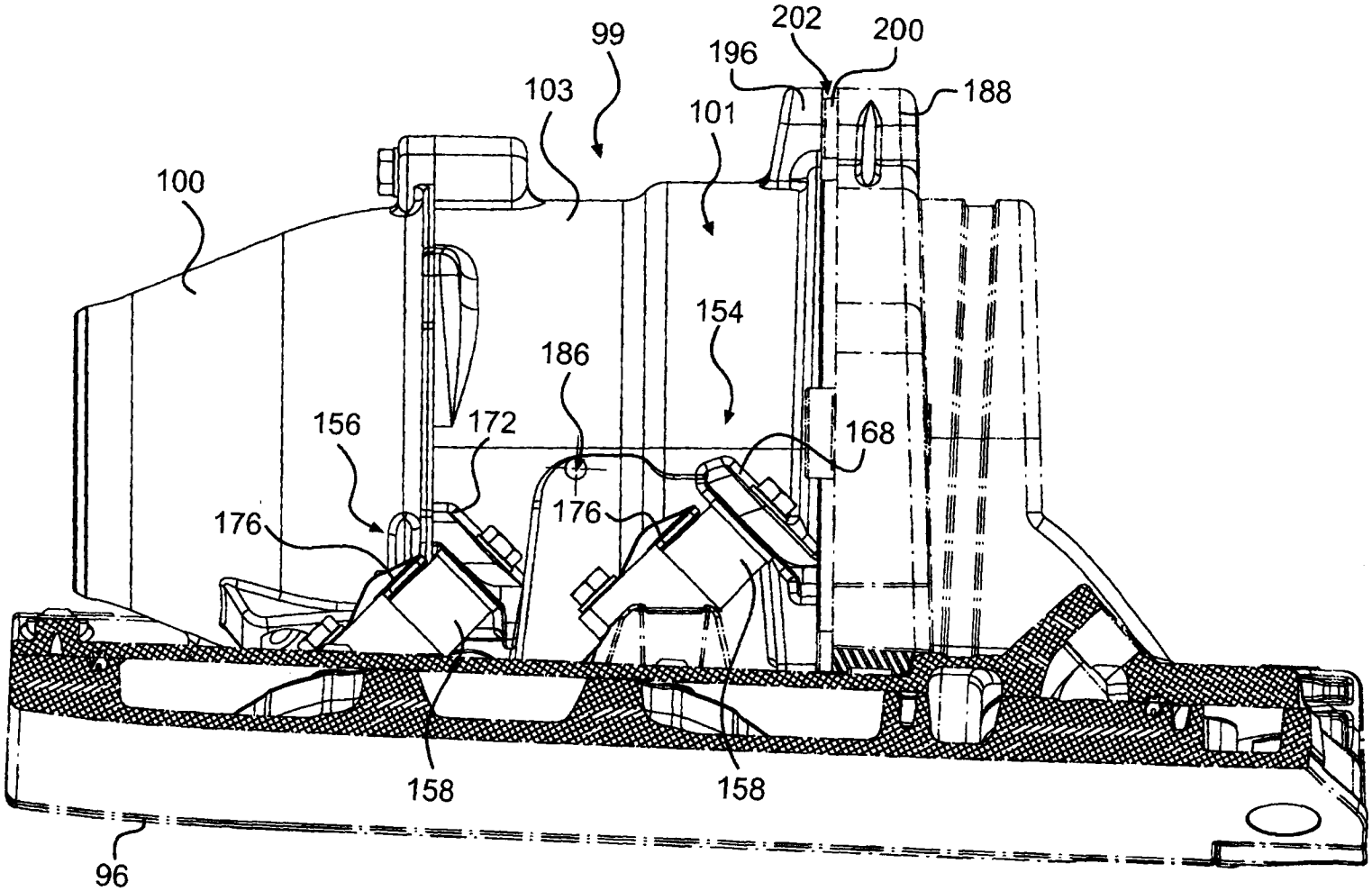
Figure 10:
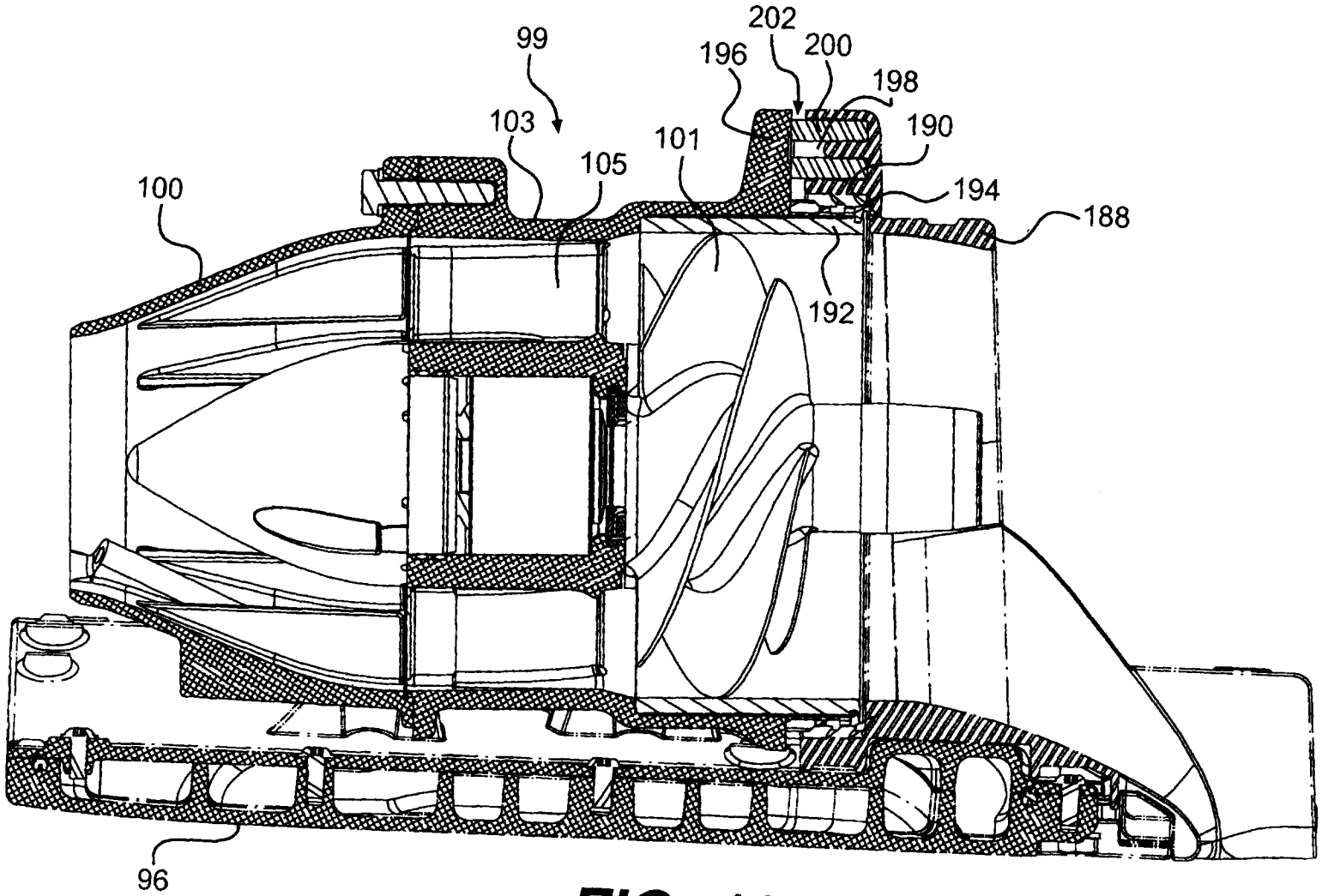
Figure 11:
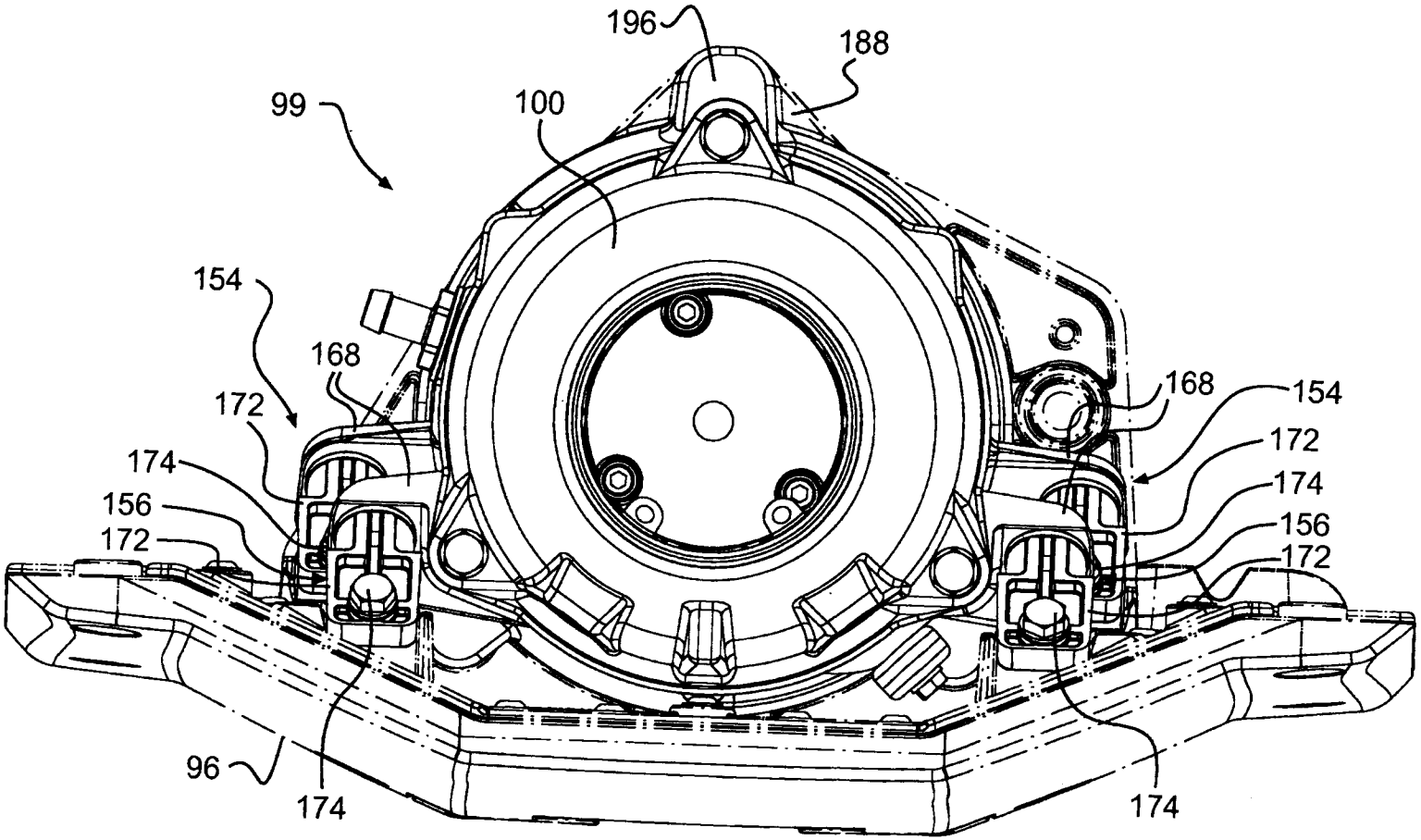
Figure 12:
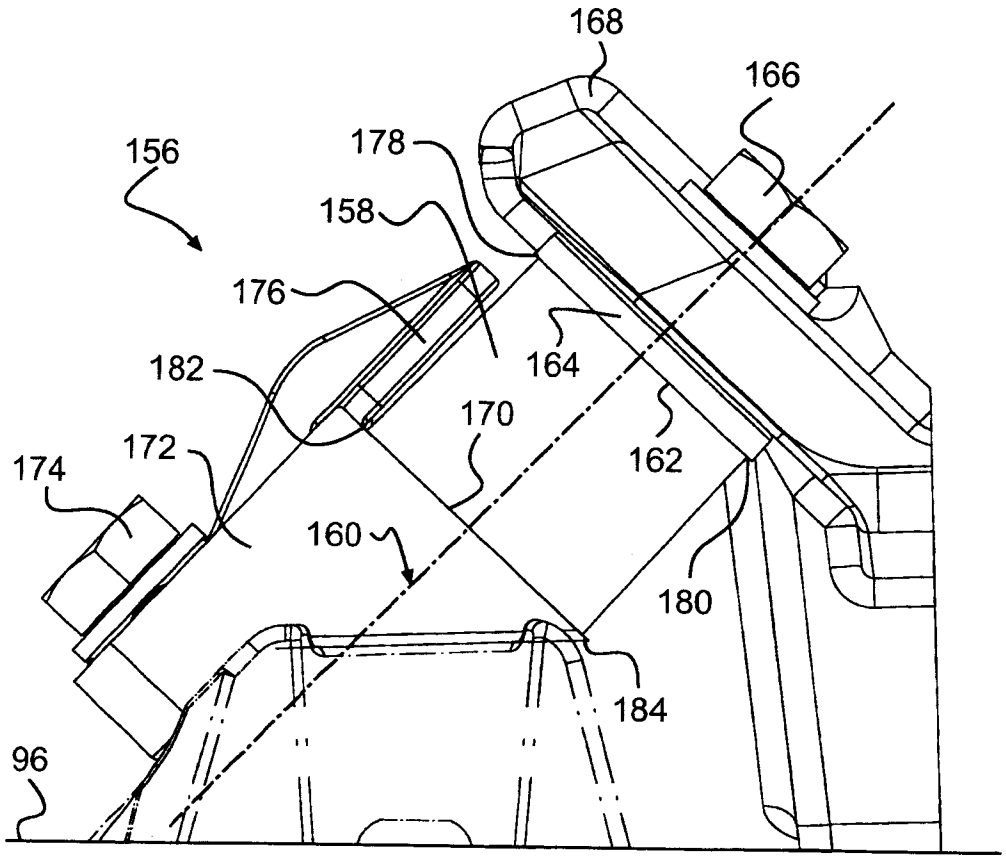
Figure 13:
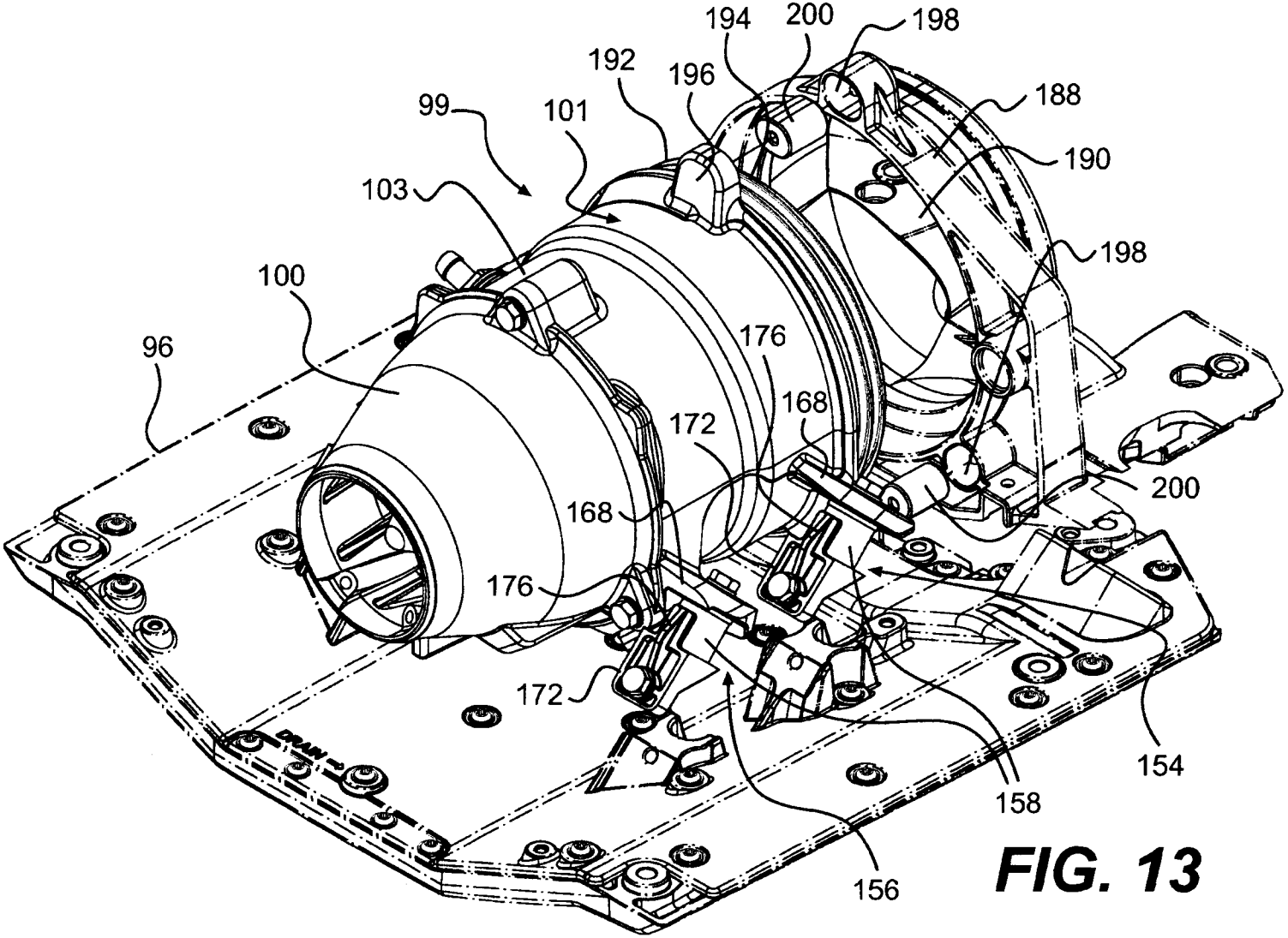
Figure 14:
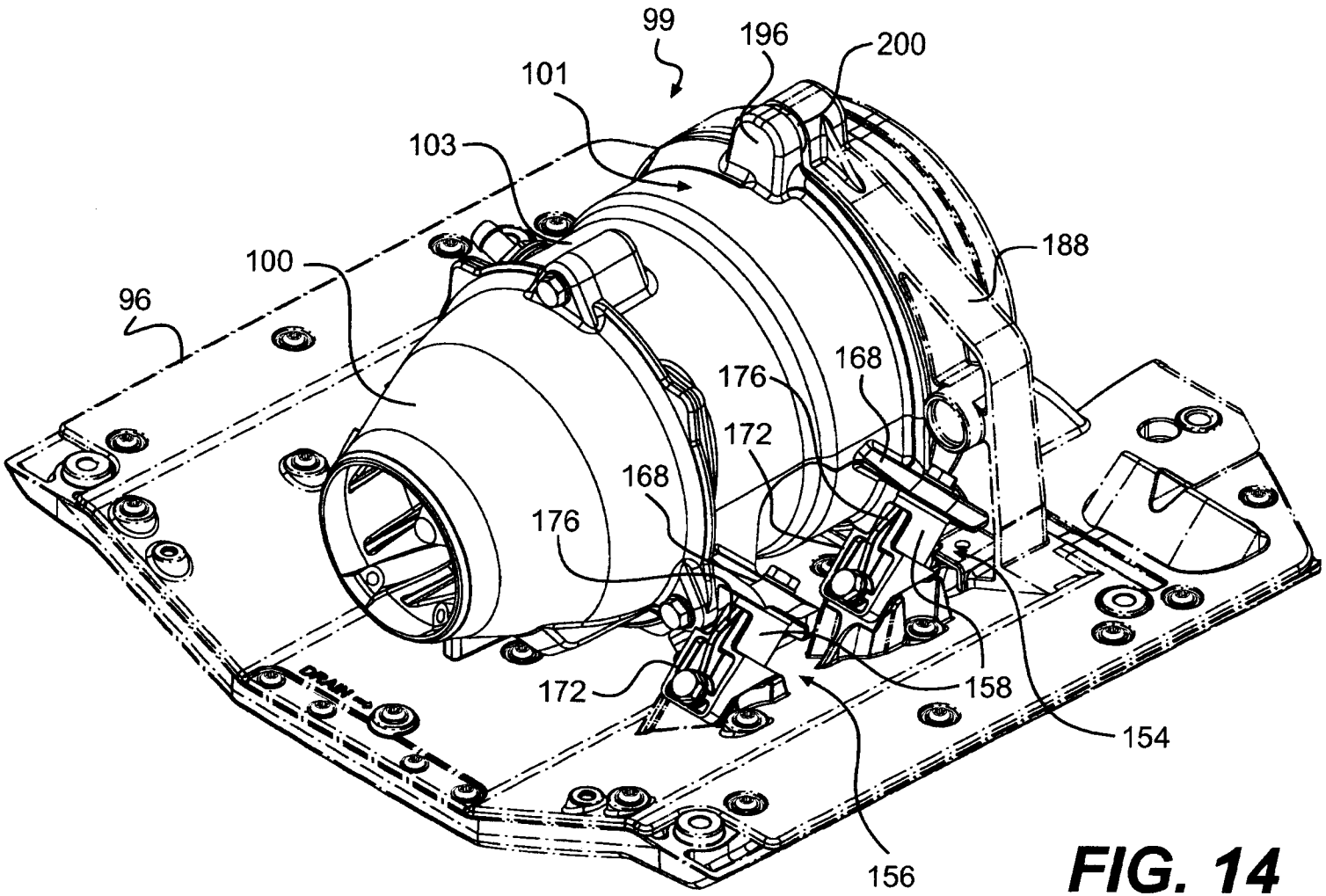

Referring to FIGS. 13 and 14, the jet pump assembly is mounted to the top surface of the ride plate 96 via four resilient mounts, consisting of a pair of front mounts 154 and a pair of rear mounts 156. It is contemplated that more or fewer resilient mounts could be used. The ride plate 96 is then mounted to the watercraft 10 in a known manner.

The rear mounts 156 will now be described, with reference to FIGS. 8-12. It should be understood that the front mounts 154 and the rear mounts 156 are of similar construction and operate in a similar manner, and as such the front mounts 154 will not be described separately in detail.

Each mount 156 comprises a resilient member 158, which may be comprised of natural rubber, butyl, neoprene or any other suitable rubber or other resilient material. The resilient material preferably has a durometer hardness between approximately A 50 and A 70. The resilient member 158 is frusto-conical in shape, and has a longitudinal axis 160. Other shapes, such as a cylinder, are contemplated for the resilient member 158. A first side 162 of the resilient member 158 is bonded to a metal plate 164. The metal plate 164 has a threaded aperture therein for receiving a bolt 166 for attachment to a mounting flange 168 of the jet pump assembly. The mounting flanges 168 of the jet pump assembly are positioned such that the front mounts 154 are disposed forwardly of the center of gravity 186 (seen in FIG. 9) of the jet pump assembly and the rear mounts 156 are disposed rearwardly of the center of gravity 186. A second side 170 of the resilient member 158, generally opposite the first side 162, is bonded to a metal mount 172. It is contemplated that the mount 172 may alternatively be made of any other suitable material, such as a reinforced or engineering plastic. The mount 172 has an angled top surface with an aperture therein for receiving a bolt 174 for attachment to the top surface of the ride plate 96. The mount 172 has a backing plate 176 extending generally parallel to the longitudinal axis 160 and spaced apart from the resilient member 158. The backing plate 176 is spaced apart from the mounting flange 168. The function of the backing plate 176 will be described below in further detail.

Figure 12:
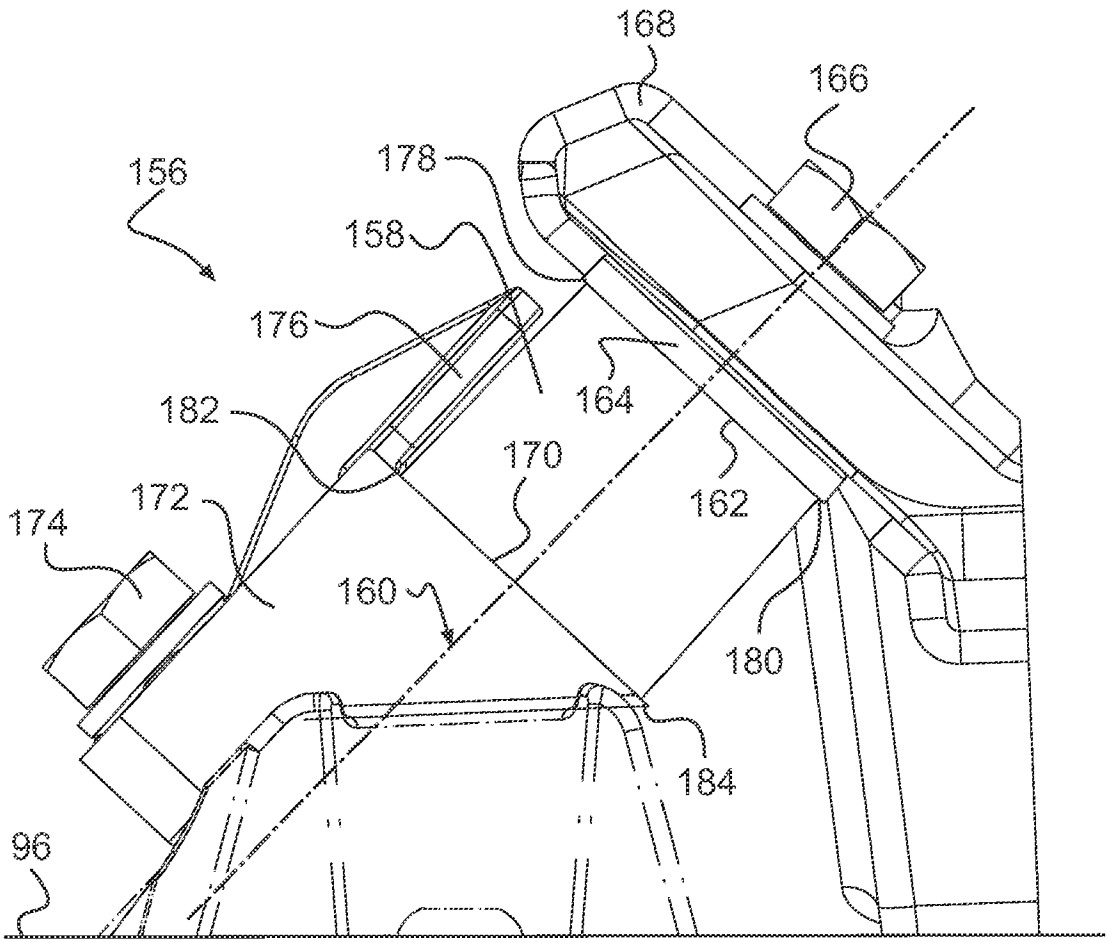
FIG. 12 is a right side elevation view of a resilient mount for the jet pump assembly of FIG. 9.

Referring now to FIG. 12, the faces of the plate 164 and the mount 172 that are bonded to the resilient member 158 are angled such that the first side 162 and the second side 170 are angled with respect to the horizontal. The first side 162 has an upper edge 178 and a lower edge 180 disposed forwardly and downwardly of the upper edge 178. The second side 170 has an upper edge 182 and a lower edge 184 disposed forwardly and downwardly of the upper edge 182.

Figure 11:
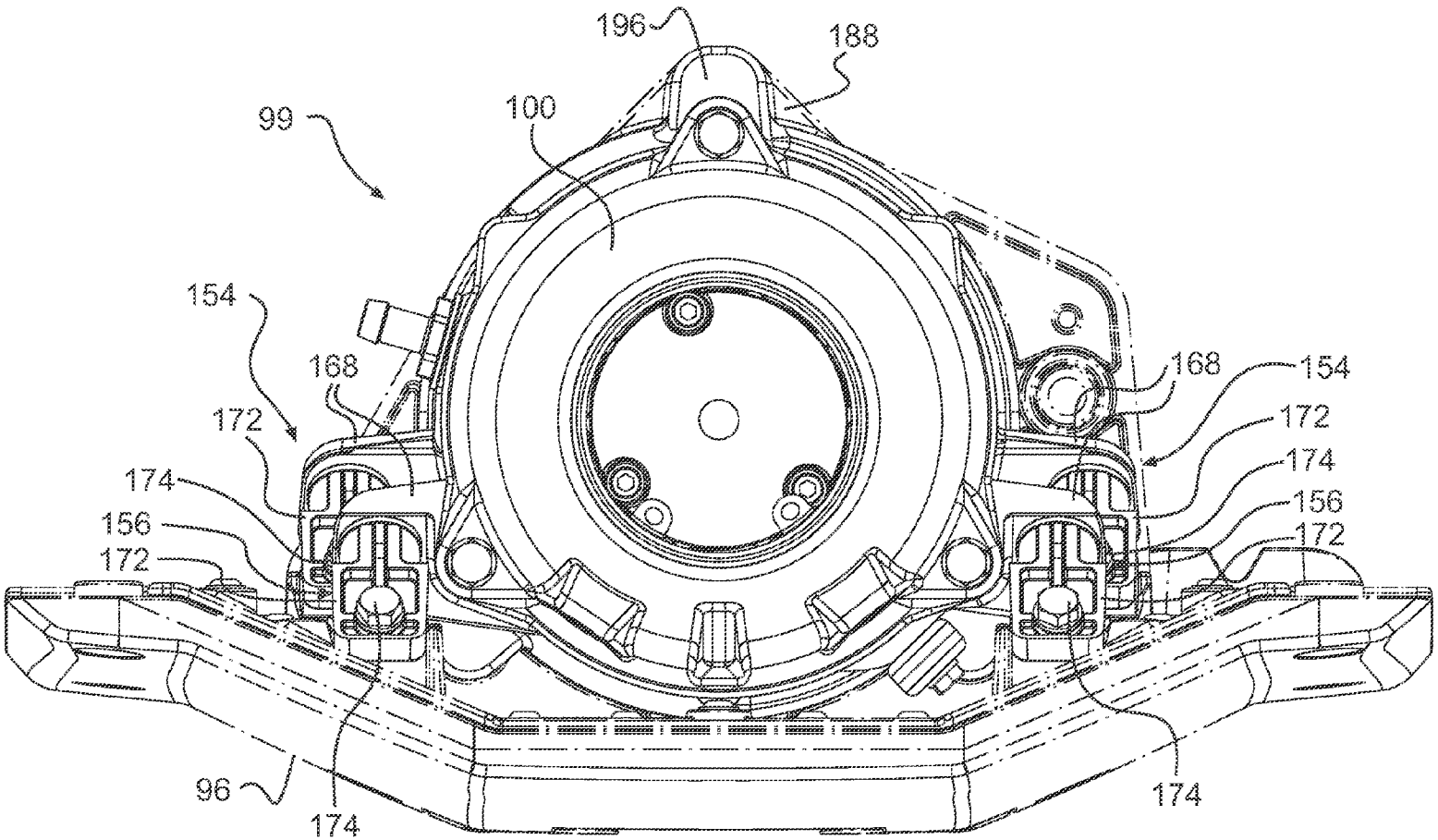
FIG. 11 is a rear elevation view of the jet pump assembly of FIG. 9.

Referring now to FIG. 11, the rear mounts 156 are disposed laterally inwardly of the front mounts 154. This arrangement, in combination with the angled top surface of the mounts 154, 156, provides easier access to the bolts 174 for removal of the jet pump assembly from the ride plate 96. Both the front mounts 154 and the rear mounts 156 are disposed laterally outwardly of the jet pump assembly to provide stability against vibrations of the jet pump assembly, in particular torsional vibrations.

Figure 10:
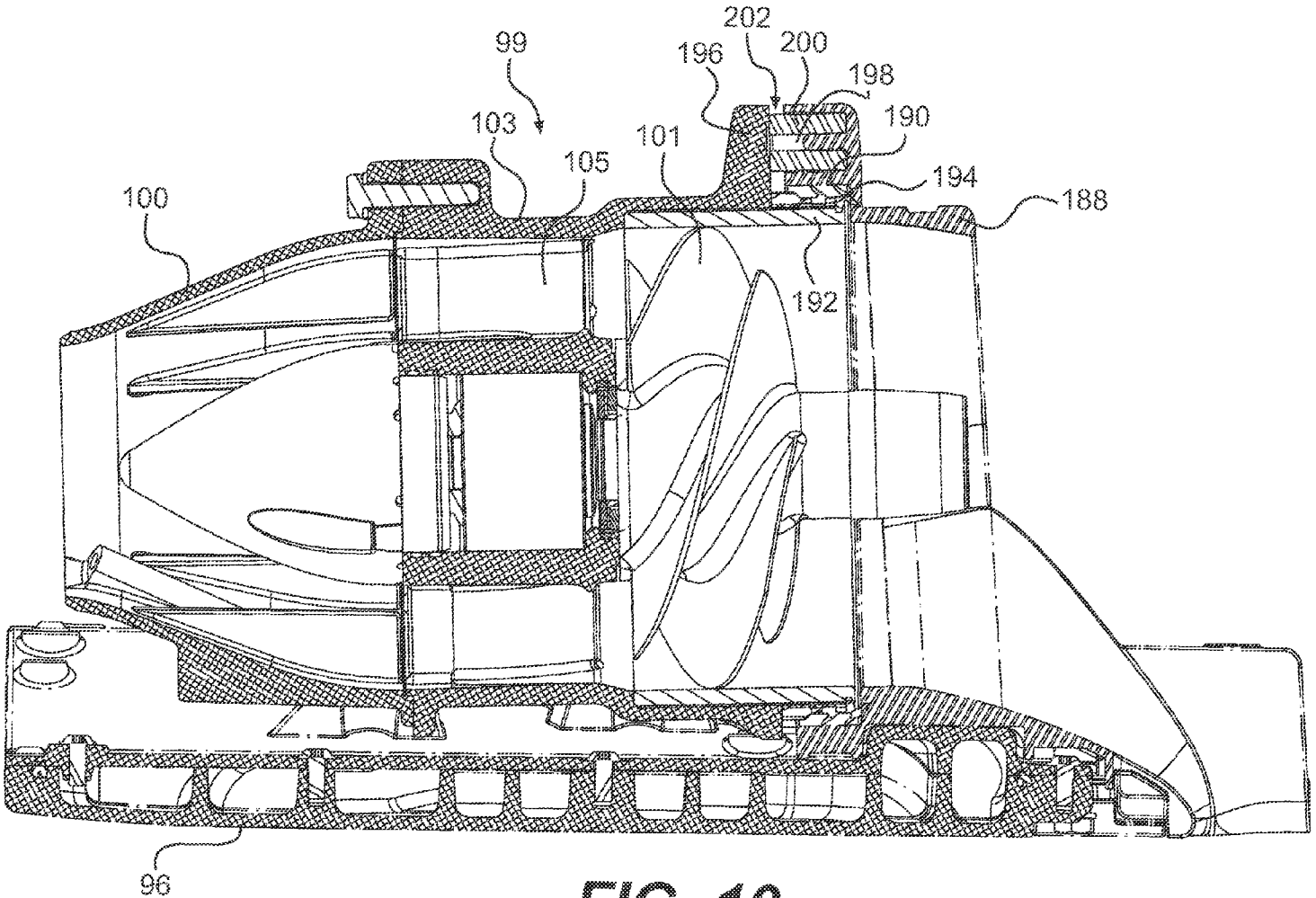
FIG. 10 is a cross-sectional view of the jet pump assembly of FIG. 9, taken along a longitudinal centerline of the jet propulsion assembly.

Referring now to FIGS. 10 and 13, the front face of the tunnel 94 is formed at least in part by a pump-mounting interface 188 mounted to the ride plate 96. A waterproof seal (not shown) is provided between the pump-mounting interface 188 and the front wall of the tunnel. It is contemplated that the pump-mounting interface 188 may alternatively be rigidly mounted to the front wall of the tunnel 94. It is contemplated that the pump-mounting interface 188 may alternatively be formed integrally with either the ride plate 96 or the front wall of the tunnel 94. The pump-mounting interface 188 has a generally cylindrical aperture 190 for receiving a generally cylindrical projection 192 of the jet pump assembly. A flexible sealing member, in the form of a sealing ring 194, forms a seal between the aperture 190 and the projection 192.

The jet pump assembly has three outwardly-extending flanges 196 and the pump-mounting interface 188 has three corresponding apertures 198. Three resilient bumpers 200 are received in the spaces 202 between the jet pump assembly and the pump mounting interface, and are held in place by the flanges 196 and the corresponding apertures 198. The bumpers 200 are positioned at various points around the rotational axis of the rotor 101, to provide stability under load. The jet pump assembly is not rigidly connected to the pump-mounting interface. The spaces 202 provide a sufficient clearance to allow the jet pump assembly to vibrate during normal operation without contacting the pump-mounting interface, thereby preventing or reducing the transmission of the vibrations to the passengers of the watercraft 10. The bumpers 200 abut against both the jet pump assembly and the pump-mounting interface 188. The bumpers 200 may contain natural rubber, butyl, neoprene or any other suitable resilient material. The resilient material preferably has a durometer hardness between approximately A 50 and A 70. The bumpers 200 may be dual compound bumpers having one part made of a first rubber with a first durometer hardness, and another part made of a second rubber with a second durometer hardness greater than the first durometer hardness, to provide a progressive vibration absorption characteristic. In this case, both rubbers would preferably have a durometer hardness between approximately A 50 and A 70. It is contemplated that there may be more or fewer than three bumpers 200. It is further contemplated that the bumpers 200 may be omitted, in which case the vibrations of the jet pump assembly would be absorbed by the mounts 154, 156, and the spaces 202 between the jet pump assembly and the pump-mounting interface would prevent the transmission of vibrations therebetween.

When the watercraft 10 is not in operation, the jet pump assembly is in a resting position and the resilient members 158 and the bumpers 200 are preferably neither in tension nor in compression, other than due to the weight of the jet pump assembly. During operation of the watercraft 10, thrust produced by the jet pump assembly may urge the jet pump assembly forwardly, toward the front wall of the tunnel 94. As a result, there is a slight tension in the resilient members 158 and a slight compression of the bumpers 200 and the sealing ring 194. The tension and compression resist movement of the jet pump assembly away from the resting position, and limit the movement of the jet pump assembly with respect to the tunnel 94. When the throttle is released, a pressure is created in front of the rotor 101 that forces the jet pump assembly rearwardly, as should be understood by persons skilled in the art. As a result, the resilient members 158 are compressed and deflected rearwardly into contact with the backing plates 176. The backing plates 176 prevent further deflection of the resilient members 158, and thereby prevent further rearward movement of the jet pump assembly which may otherwise result in leakage around the sealing ring 194. A similar effect occurs when the jet pump assembly is operated with the reverse gate 110 in the downward position. Any vibrations produced by the jet pump assembly during operation of the watercraft 10 are absorbed by the resilient members 158 and the bumpers 200, and are not transmitted to the hull 12 or the riders because there is no rigid connection between the jet pump assembly and the hull 12.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:

a hull;

a deck disposed above the hull;

an engine compartment defined between the hull and the deck;

an engine disposed in the engine compartment;

a ride plate mounted below a rear portion of the hull;

a steering assembly disposed at least in part on the deck;

a jet pump assembly operatively connected to the engine for propelling the watercraft, the jet pump assembly including a jet pump disposed at least in part between the ride plate and the hull; and a front wall formed at least in part by the hull and disposed forwardly of the jet pump; the jet pump being mounted on a top surface of the ride plate via a plurality of resilient mounts disposed between the ride plate and the jet pump assembly, the plurality of resilient mounts including a pair of front resilient mounts and a pair of rear resilient mounts, the jet pump assembly being disposed laterally inwardly of at least one pair of the resilient mounts, the jet pump and the front wall having a space therebetween and at least one sealing member disposed in the space, the at least one sealing member forming a seal between the portion of the jet pump and the portion of the front wall.

2. The watercraft of claim 1, wherein the pair of rear resilient mounts are disposed laterally inwardly of the pair of front resilient mounts.

3. The watercraft of claim 1, wherein the pair of front resilient mounts are disposed forwardly of a center of gravity of the jet pump assembly; and the pair of rear resilient mounts are disposed rearwardly of the center of gravity of the jet pump assembly.

4. The watercraft of claim 1, further comprising at least one resilient bumper disposed between the jet pump assembly and the front wall.

5. The watercraft of claim 4, wherein the at least one resilient bumper is a dual compound bumper comprising a first resilient material having a first durometer hardness and a second resilient material having a second durometer hardness greater than the first durometer hardness.

6. The watercraft of claim 1, wherein each resilient mount has a first side mounted to the jet pump; and a second side mounted to the ride plate, the first side having a first upper edge; and a first lower edge, the first lower edge being disposed forwardly and downwardly of the first upper edge, the second side having a second upper edge; and a second lower edge, the second lower edge being disposed forwardly and downwardly of the second upper edge.

7. The watercraft of claim 1, wherein each resilient mount includes:

a resilient member having a first side, and a second side generally opposite the first side;

a metal plate bonded to the first side, the metal plate having a thread formed therein for receiving a bolt; and a metal mount bonded to the second side;

the resilient mount being fastened to the jet pump assembly via the metal plate, the resilient mount being fastened to the ride plate via the metal mount.

8. The watercraft of claim 7, wherein each resilient member is frusto-conical.

9. The watercraft of claim 8, wherein each metal mount has a backing plate extending generally parallel to a longitudinal axis of a corresponding resilient member, the backing plate being spaced apart from the resilient member.

10. A watercraft comprising:

a hull;

a deck disposed above the hull;

an engine compartment defined between the hull and the deck;

an engine disposed in the engine compartment;

a ride plate mounted below a rear portion of the hull;

a steering assembly disposed at least in part on the deck; and a jet pump assembly operatively connected to the engine for propelling the watercraft, the jet pump assembly including a jet pump disposed at least in part between the ride plate and the hull and being mounted to the watercraft only via a plurality of mounting points, the jet pump being resiliently mounted to the watercraft via each of the plurality of mounting points, the plurality of mounting points including a pair of front mounting points having front resilient mounts and a pair of rear mounting points having rear resilient mounts, each of the pair of front resilient mounts and the pair of rear resilient mounts including:

a resilient member having a first side, and a second side generally opposite the first side;

a metal plate bonded to the first side, the metal plate having a thread formed therein for receiving a bolt; and a metal mount bonded to the second side;

the resilient mount being fastened to the jet pump assembly via the metal plate, and the resilient mount being fastened to the ride plate via the metal mount.

11. The watercraft of claim 10, wherein the jet pump is mounted on a top surface of the ride plate via the pair of front resilient mounts and the pair of rear resilient mounts.

12. The watercraft of claim 11, wherein the pair of rear resilient mounts are disposed laterally inwardly of the pair of front resilient mounts.

13. The watercraft of claim 11, wherein the pair of front resilient mounts are disposed forwardly of a center of gravity of the jet pump assembly; and the pair of rear resilient mounts are disposed rearwardly of the center of gravity of the jet pump assembly.

14. The watercraft of claim 10, further comprising a front wall formed at least in part by the hull and disposed forwardly of the jet pump;

wherein the plurality of mounting points includes at least one resilient bumper disposed between the jet pump assembly and the front wall.

15. The watercraft of claim 14, wherein the at least one resilient bumper is a dual compound bumper comprising a first resilient material having a first durometer hardness and a second resilient material having a second durometer hardness greater than the first durometer hardness.

16. The watercraft of claim 10, wherein each of the pair of front resilient mounts and the pair of rear resilient mounts has a first side mounted to the jet pump; and a second side mounted to the ride plate, the first side having a first upper edge; and a first lower edge, the first lower edge being disposed forwardly and downwardly of the first upper edge, the second side having a second upper edge; and a second lower edge, the second lower edge being disposed forwardly and downwardly of the second upper edge.

17. The watercraft of claim 10, wherein each resilient member is frusto-conical.

18. The watercraft of claim 17, wherein each metal mount has a backing plate extending generally parallel to a longitudinal axis of a corresponding resilient member, the backing plate being spaced apart from the resilient member.

* * * * *

UNITED STATES PATENT AND TRADEMARK OFFICE

CERTIFICATE OF CORRECTION

PATENT NO. : 7,803,025 B2
APPLICATION NO. : 12/046702
DATED : September 28, 2010
INVENTOR(S) : Andre Denis et al.

It is certified that error appears in the above-identified patent and that said Letters Patent is hereby corrected as shown below:

The title page, showing an illustrative figure should be deleted and substitute therefor the attached title page.

The sheets of drawings consisting of figures 1-14 , should be deleted to appear as per attached figures 1-14.

Signed and Sealed this
Nineteenth Day of April, 2011

David J. Kappos

David J. Kappos
*Director of the United States Patent and Trademark Office*

(12) United States Patent
Denis et al.

(10) Patent No.: US 7,803,025 B2
(45) Date of Patent: Sep. 28, 2010

(54) SYSTEM FOR MOUNTING A MARINE JET PROPULSION SYSTEM

(75) Inventors: Andre Denis, Sherbrooke (CA); Michel Bourret, Drummonville (CA); Marc Schuler, Sherbrooke (CA)

(73) Assignee: Bombardier Recreational Products Inc., Valcourt (CA)

( * ) Notice: Subject to any disclaimer, the term of this patent is extended or adjusted under 35 U.S.C. 154(b) by 219 days.

(21) Appl. No.: 12/046,702

(22) Filed: Mar. 12, 2008

(65) Prior Publication Data

US 2009/0233499 A1 Sep. 17, 2009

(51) Int. Cl.
*B63H 11/00* (2006.01)

(52) U.S. Cl. ..... 440/38

(58) Field of Classification Search ..... 440/38
See application file for complete search history.

(56) References Cited

U.S. PATENT DOCUMENTS 5,460,553 A 10/1995 Craig et al.
6,101,965 A * 8/2000 Koyanagi ..... 114/288
7,179,142 B2 2/2007 Fuse

* cited by examiner

*Primary Examiner*—Stephen Avila
(74) *Attorney, Agent, or Firm*—Osler, Hoskin & Harcourt LLP

(57) ABSTRACT

A watercraft has a hull and a deck disposed above the hull. A ride plate is mounted below a rear portion of the hull. A jet pump assembly includes a jet pump disposed at least in part between the ride plate and the hull. A front wall is formed at least in part by the hull and disposed forwardly of the jet pump. The jet pump assembly is mounted on a top surface of the ride plate via a plurality of resilient mounts At least one sealing member forms a seal between the portion of the jet pump and the portion of the front wall. The jet pump is mounted to the watercraft only via a plurality of mounting points. The jet pump is resiliently mounted to the watercraft via each of the plurality of mounting points.

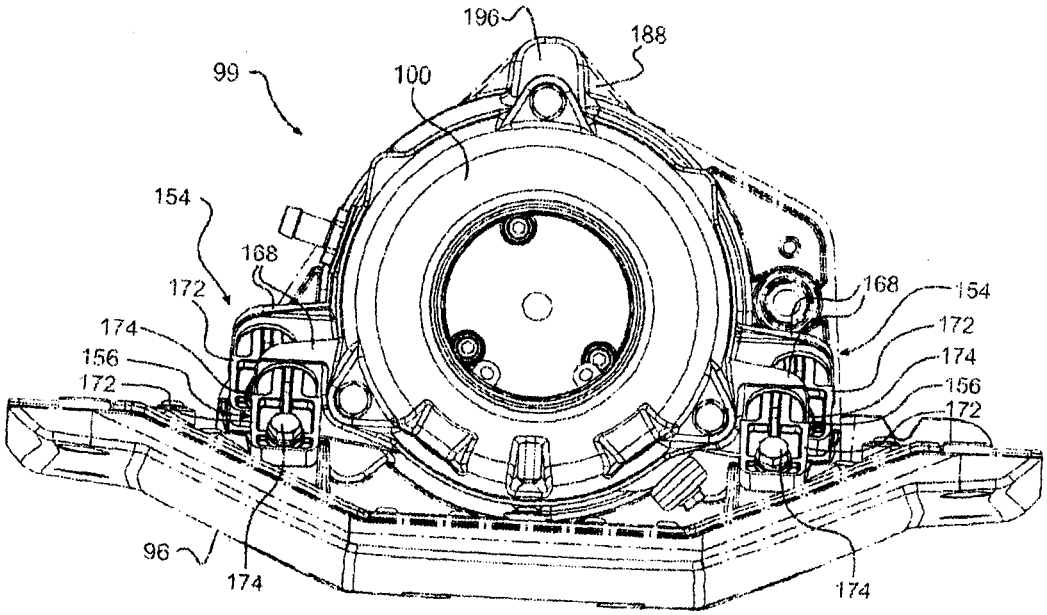

18 Claims, 13 Drawing Sheets